US008009184B2

(12) United States Patent
Saquib

(10) Patent No.: US 8,009,184 B2
(45) Date of Patent: Aug. 30, 2011

(54) THERMAL RESPONSE CORRECTION SYSTEM FOR MULTICOLOR PRINTING

(75) Inventor: Suhail S. Saquib, Shrewsbury, MA (US)

(73) Assignee: ZINK Imaging, Inc., Bedford, MA (US)

( * ) Notice: Subject to any disclaimer, the term of this patent is extended or adjusted under 35 U.S.C. 154(b) by 113 days.

(21) Appl. No.: 12/468,413

(22) Filed: May 19, 2009

(65) Prior Publication Data

US 2009/0309946 A1 Dec. 17, 2009

Related U.S. Application Data

(60) Provisional application No. 61/061,112, filed on Jun. 13, 2008.

(51) Int. Cl.
*B41J 2/36* (2006.01)
*B41J 2/365* (2006.01)

(52) U.S. Cl. ..... 347/195; 347/196

(58) Field of Classification Search ..... 347/188, 347/189, 194, 195, 196; 400/120.09, 120.14, 400/120.15

See application file for complete search history.

(56) References Cited

U.S. PATENT DOCUMENTS 5,132,703 A 7/1992 Nakayama
6,801,233 B2 10/2004 Bhatt et al.
6,819,347 B2 11/2004 Saquib et al.
7,176,953 B2 2/2007 Saquib et al.
7,295,224 B2 11/2007 Busch et al.
7,298,387 B2 11/2007 Busch et al.
7,408,563 B2 8/2008 Busch et al.
2005/0007438 A1* 1/2005 Busch et al. ..... 347/175
2006/0159502 A1 7/2006 Saquib
2006/0232642 A1 10/2006 Busch et al.
2008/0238967 A1 10/2008 Busch et al.

* cited by examiner

*Primary Examiner* — Huan H Tran
(74) *Attorney, Agent, or Firm* — Robert Plotkin, P.C.

(57) ABSTRACT

Thermal history control is performed in a thermal printer in which a single thermal print head prints sequentially on multiple color-forming layers in a single pass. Each pixel-printing interval may be divided into segments, each of which may be used to print a different color. The manner in which the input energy to be provided to each print head element is selected may be varied for each of the segments. Different energy computation functions may be used to compute the energy to be provided to the print head in each of the segments based on the predicted print head element temperature at the beginning of the segment, the color to be printed, and the energy that was supplied when printing other colors during the time period between the beginning of the segment of the current pixel-printing interval and the end of the equivalent segment of the previous pixel-printing interval.

28 Claims, 16 Drawing Sheets

THERMAL RESPONSE CORRECTION SYSTEM FOR MULTICOLOR PRINTING

CROSS REFERENCE TO RELATED APPLICATIONS

This application claims priority from U.S. Prov. Pat. App. Ser. No. 61/061,112, filed Jun. 13, 2008, entitled, "Thermal Response Correction System for Multicolor Printing," which is hereby incorporated by reference herein.

This application is related to the following United States patents and patent applications, which are hereby incorporated by reference:

U.S. Pat. No. 6,819,347, which describes and claims a method for compensation of distortions induced by thermal history in a thermal printer;

U.S. Pat. No. 7,176,953, which describes and claims a method for thermal history compensation in a thermal printer that includes a correction for the temperature of a thermal imaging member;

U.S. Pat. No. 7,295,224, which describes and claims a method for thermal history compensation in a thermal printer that includes corrections for ambient temperature and humidity;

U.S. Pat. No. 7,298,387, which describes and claims a method for thermal history compensation in a thermal printer for printing more than one color during a single pass of a thermal printing head;

U.S. patent application Ser. No. 11/332,530, filed on Jan. 13, 2006 (published application no. US 2006/0159502 A1), which describes and claims methods for parameter estimation for thermal history control algorithms;

U.S. Pat. No. 6,801,233, which describes thermal imaging methods and members for use in the present invention;

U.S. patent application Ser. No. 11/400,734, filed Apr. 6, 2006, which describes and claims an imaging method for use in the present invention;

U.S. patent application Ser. No. 11/400,735, filed Apr. 6, 2006, which describes and claims an imaging method for use in the present invention; and U.S. patent application Ser. No. 12/022,955, filed on Jan. 30, 2008, which describes and claims an imaging method for use in the present invention.

BACKGROUND

1. Field

The present invention relates to thermal printing and, more particularly, to techniques for improving thermal printer output by compensating for the effects of thermal history on thermal print heads.

2. Related Art

Thermal printers typically contain a linear array of heating elements (also referred to herein as "print head elements") that print on an output medium by, for example, transferring pigment or dye from a donor sheet to the output medium or by activating a color-forming chemistry in the output medium. The array of heating elements is a component of a thermal print head (also referred to herein as a "thermal printing head" or "TPH") that also includes a support and driving circuitry, as described in more detail below. The output medium is typically a porous receiver receptive to the transferred pigment, or a paper coated with the color-forming chemistry. Each of the print head elements, when activated, forms color on the medium passing underneath the print head element, creating a spot having a particular optical density (hereinafter the term "density" refers to "optical density" unless otherwise specified). Regions with larger or denser spots are perceived as darker than regions with smaller or less dense spots. Digital images are rendered as two-dimensional arrays of very small and closely-spaced spots.

A thermal print head heating element (also referred to herein as a "heating element" or "print head element") is activated by providing it with energy. Providing energy to the print head element increases the temperature of the print head element, causing either the transfer of pigment to the output medium or the formation of color in the receiver. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "print head cycles". Typically, a single row of pixels (or portions thereof) in the digital image is printed during a single print head cycle. Each print head heating element is typically responsible for printing pixels in a particular column of the digital image. During each print head cycle, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is typically calculated based on an assumption that the print head element's temperature at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the desired temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density drift."

Furthermore, conventional thermal printers typically have difficulty accurately reproducing sharp density gradients between adjacent pixels both across the print head and in the direction of printing. For example, if a print head element is to print a black pixel following a white pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

The above-mentioned patents and patent applications introduce techniques that obviate many of these problems for thermal printers that print a single color in one pass of the thermal print head. Such methods may also be employed when more than one color is printed in a single pass of a thermal print head onto a thermal imaging member capable of rendering more than one color. Examples of such thermal imaging members, and methods for printing thereon, are described in U.S. Pat. No. 6,801,233, and U.S. patent application Ser. Nos. 11/400,734 and 11/400,735. However, there still remains a need for improved methods for thermal history control when multiple colors are printed in a single pass.

The single-color thermal history control methods of the prior art comprise two distinct models: a thermal model (of the thermal print head) and a "media model" that computes the color density achieved in a thermal imaging member (also known in the art as a "medium") as a function of a supplied energy (or the inverse of this function). It is straightforward to generalize the prior art thermal model to the case in which multiple colors are printed in a single pass. The parameters of the thermal model may be adjusted to account for the differing printing times and power levels that may be required for different colors, thereby allowing an accurate tracking of the state of the thermal print head (and, in particular, the temperature of the print head elements) while printing. It might be thought that the media model could be carried over to the multicolor case as well, since in its prior art embodiment it requires as input only the current state of the thermal print head, the desired density to be printed, and certain fixed parameters appropriate to that particular color.

However, such a straightforward generalization of the media model may be inadequate for multicolor printing. Problems that may occur include lack of a clean separation between the thermal and the media model, making it difficult to fine tune the thermal history response and/or adapt a thermal history characterization from one thermal imaging member to another; unstable or oscillatory responses to attempts to adjust the thermal model parameters to achieve a desired response; physically unreasonable values being obtained in the thermal model as a result of insufficient flexibility (in technical terms, insufficient degrees of freedom) in the media model; and non-monotonic or ill-defined responses of the thermal history control algorithm over a 3-D color space. Note that when thermal history compensation fails in the multicolor case, not only are distortions in density possible, but distortions in color may occur as well, with objectionable results in a final image. For all these reasons, there is a need for an improved thermal history control algorithm for printing multiple colors on a thermal imaging member with a thermal printer.

SUMMARY

Techniques are disclosed for performing thermal history control in a thermal printer in which a single thermal print head prints sequentially on multiple color-forming layers in a single pass. Each pixel-printing interval may be divided into segments which may be of unequal duration. Each segment may be used to print a different color. The manner in which the input energy to be provided to each print head element is selected may be varied for each of the segments. For example, although a single thermal model may be used to predict the temperature of the print head elements in each of the segments, different parameters may be used in the different segments. Similarly, different energy computation functions may be used to compute the energy to be provided to the print head in each of the segments based on the predicted print head element temperature at the beginning of the segment, the color to be printed, and the energy that was supplied when printing other colors during the time period between the beginning of the segment of the current pixel-printing interval and the end of the equivalent segment of the previous pixel-printing interval.

In another aspect of the present invention, a method is provided for thermally printing at least a first and a second dot in first and second color-forming layers, respectively, of a thermal imaging member having first and second opposed surfaces and comprising a plurality of color-forming layers, comprising steps of:

(A) heating a first region of a surface of the thermal imaging member with a thermal print head to supply a first amount of energy to print the first dot; and (B) heating a second region of said surface of the thermal imaging member, that overlaps the first region, with a thermal print head to supply a second amount of energy to print the second dot;

wherein the second amount of energy is corrected by an amount that depends upon the first amount of energy and the location of the second color-forming layer within the thermal imaging member, and wherein the first and second dots are printed in a single pass of thermal print head.

In another aspect of the present invention, a method is provided that includes steps of:

(A) identifying a density value of a color component of a pixel in the digital image, the pixel comprising N color components, each color component associated with one of N printing segments of a printing line time where N>1;

(B) identifying the amount of energy supplied to the heating element during each of the previous N−1 printing segments;

(C) computing an input energy amount using an energy computation function comprising steps of:

(C) (1) computing a first-order input energy amount based on the density value, and (C) (2) making corrections to said first-order input energy amount based on the amounts of energy supplied to the heating element during each of the previous N−1 printing segments, wherein the magnitude of said corrections depends upon the density value; and (D) supplying energy equal to the input energy amount to the heating element.

As used herein, the term "identify" may refer to a process of looking up a value in, for example, a table; to performing a calculation; or to making a measurement. Such "identifying" may be performed by an electronic device and may be implemented, for example, in hardware, software, firmware, or any combination thereof. The "identifying" may be implemented in one or more computer programs executing on a programmable computer and/or printer including a processor, a storage medium readable by the processor (including, for example, volatile and non-volatile memory and/or storage elements), at least one input device, and at least one output device.

In yet another aspect of the invention, there is provided a method for estimation of parameters for use in the present invention, comprising steps of:

(A) choosing a set of input energies to supply to a printer;

(B) printing an image using the printer with the set of input energies;

(C) measuring the printed densities of regions of the image corresponding to each input energy in the set of input energies;

(D) estimating the energies required to attain each of the measured printed densities using a set of parameters; and (E) adjusting the set of parameters so as to minimize the differences between the estimates of the energy required to attain the measured printed densities and the input energies supplied to the printer to achieve the measured printed densities.

Additional aspects and embodiments of the present invention will be described in more detail below.

DETAILED DESCRIPTION

Figure 1:
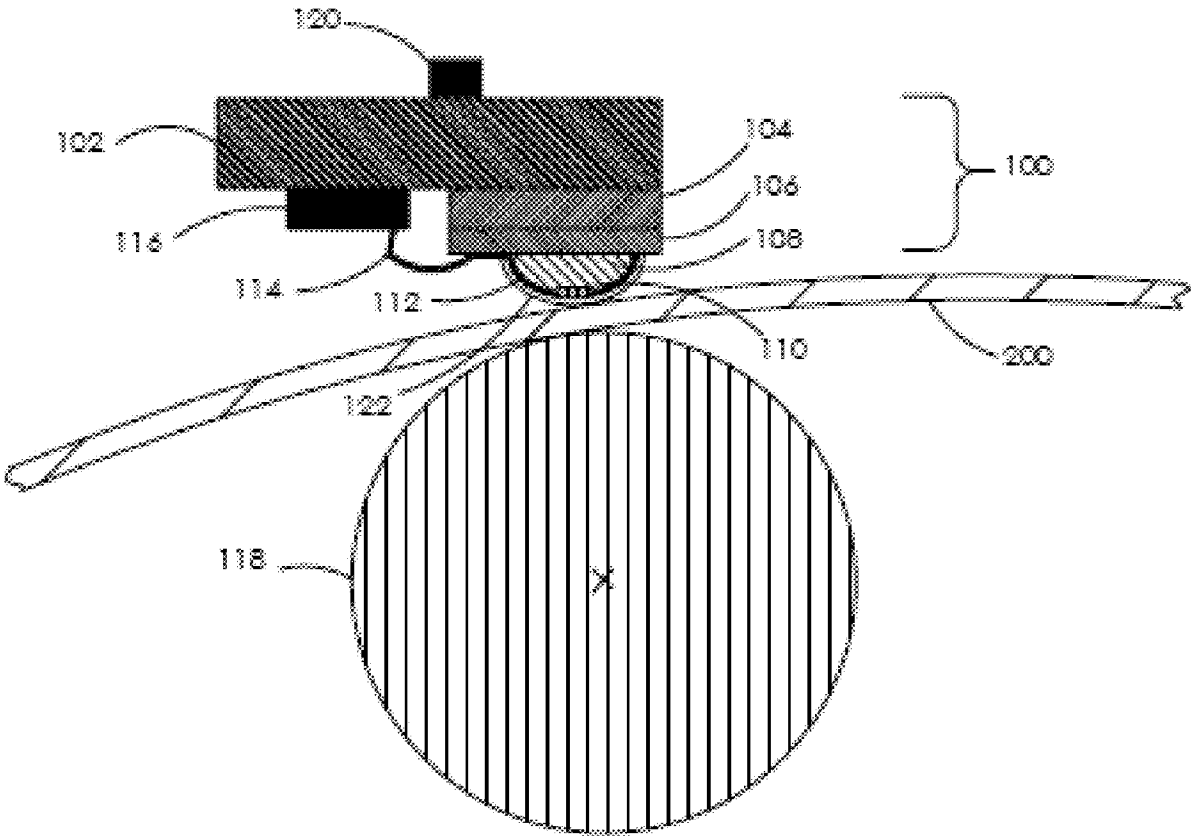
FIG. 1 is a partially schematic, side sectional view of a thermal printing head addressing a thermal imaging member according to the invention.

Referring now to FIG. 1, there is seen a schematic, cross-sectional view of a typical thermal printing arrangement in which a thermal printing head 100 and thermal imaging member 200 are held in intimate contact by a platen 118 (that may be a roller (as shown) or a nonrotating element) that biases the thermal imaging member 200 against thermal printing head 100. As shown in FIG. 1, a typical thermal printing head comprises a support 102 that carries both the driving circuitry 116 and the assembly comprising the print head elements. This support 102 comprises a heat sink whose temperature is monitored by a temperature measuring device 120 that may be, for example, a thermistor. The print head elements 110 are carried by a glaze layer 106 in contact with a ceramic substrate 104, and are covered by a thin, thermally-conductive overcoat 122. Ceramic substrate 104 is in contact with support 102. Shown in the figure is an optional raised "glaze bump" 108 on which the print head elements 110 are located. The print head elements may be carried by the surface of glaze layer 106 when glaze bump 108 is absent. Wires 114 provide electrical contact between the print head elements 110 and the driving circuitry 116 through patterned conductive connections 112. Print head elements 110 are in contact with the imaging member 100 through the thin, thermally-conductive overcoat layer. In the arrangement of FIG. 1, therefore, control of the amplitude and duration of the electrical power supplied to the print head elements 110 controls the temperature evolution of the surface of imaging member 200.

In a preferred embodiment of the present invention, thermal printing head 100 is held fixed relative to the chassis of the printer while imaging member 200 is transported past the print head elements 110. The transport of the thermal imaging member may be by means of drive rollers (not shown), by driven rotation of the platen 118, or by other transport means that are known in the art. In some alternative embodiments, the thermal imaging member is held fixed, and the print head is moved. It is also possible that both elements are movable.

Figure 2:
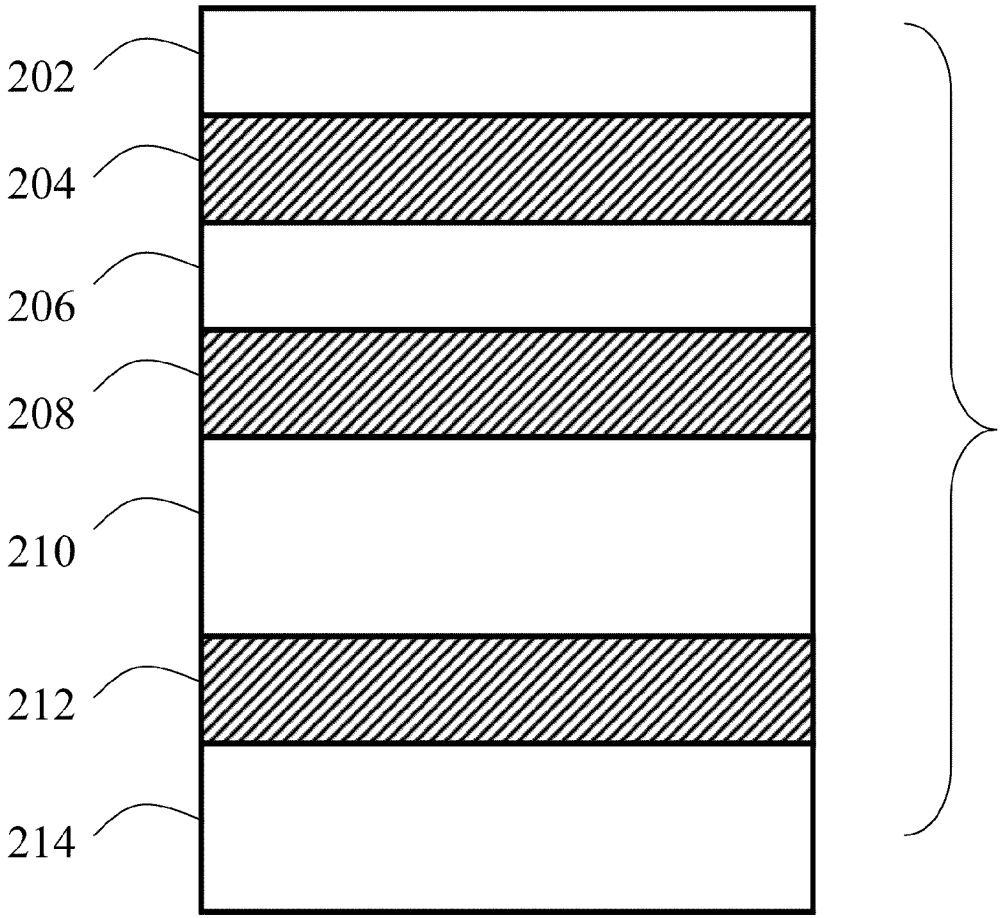
FIG. 2 is a partially schematic, side sectional view of a three-color thermal imaging member according to the invention.

Referring now to FIG. 2, there is seen a thermal imaging member 200 that includes a substrate 214, that can be transparent, absorptive, or reflective; three color-forming layers 204, 208, and 212, that may be yellow, magenta and cyan, respectively; spacer layers 206 and 210; and an overcoat layer 202.

Each color-forming layer changes color, e.g., from initially colorless to colored, when heated to a particular temperature referred to herein as its activating temperature. The activating temperatures of color-forming layers 204, 208 and 212 are in the order 204>208>212. As described in detail in U.S. Pat. No. 6,801,233, addressing (i.e., heating to above its activating temperature) layer 212 is achieved by heating the surface of the imaging member 200 to a relatively low temperature for a relatively long time; addressing layer 208 is achieved by heating the surface of the imaging member 200 to an intermediate temperature for an intermediate length of time; and addressing layer 204 is achieved by heating the surface of the imaging member 200 to a relatively high temperature for a relatively short time.

Any color order of the color-forming layers can be chosen. One preferred color order is as described above. Another preferred color order is one in which the three color-forming layers 204, 208, and 212 are cyan, magenta and yellow, respectively.

The function of the spacer layers is control of thermal diffusion within the imaging member 200. Spacer layer 206 is preferably thinner than spacer layer 210, provided that the materials comprising both layers have substantially the same thermal diffusivity. Preferably, in such a case, spacer layer 210 is at least four times thicker than spacer layer 206.

Although six layers are shown disposed on the substrate in FIG. 2, additional barrier layers may be incorporated into the thermal imaging member, for example to protect the image from atmospheric oxygen, ultraviolet radiation, or to prevent diffusion of chemicals between the layers. The presence or absence of such layers does not affect the methods or devices of the present invention. An example of a preferred thermal imaging member of the present invention is described in U.S. patent application Ser. No. 11/400,735.

All the layers disposed on the substrate 214 are substantially transparent before color formation. When the substrate 214 is reflective (e.g., white), the colored image formed on imaging member 200 is viewed through the overcoat 202 against the reflecting background provided by the substrate 214. The translucency of the layers disposed on the substrate ensures that the colors printed in each of the color-forming layers may be viewed in combination.

During a single pass of the imaging member 200 past the print head elements, precise control of the amplitude and duration of the power supplied to the print head elements allows any combination of colors to be formed in the three color-forming layers 204, 208 and 212. In other words, a full-color image may be printed in a single pass of imaging member 200 beneath thermal printing head 100.

Figure 3:
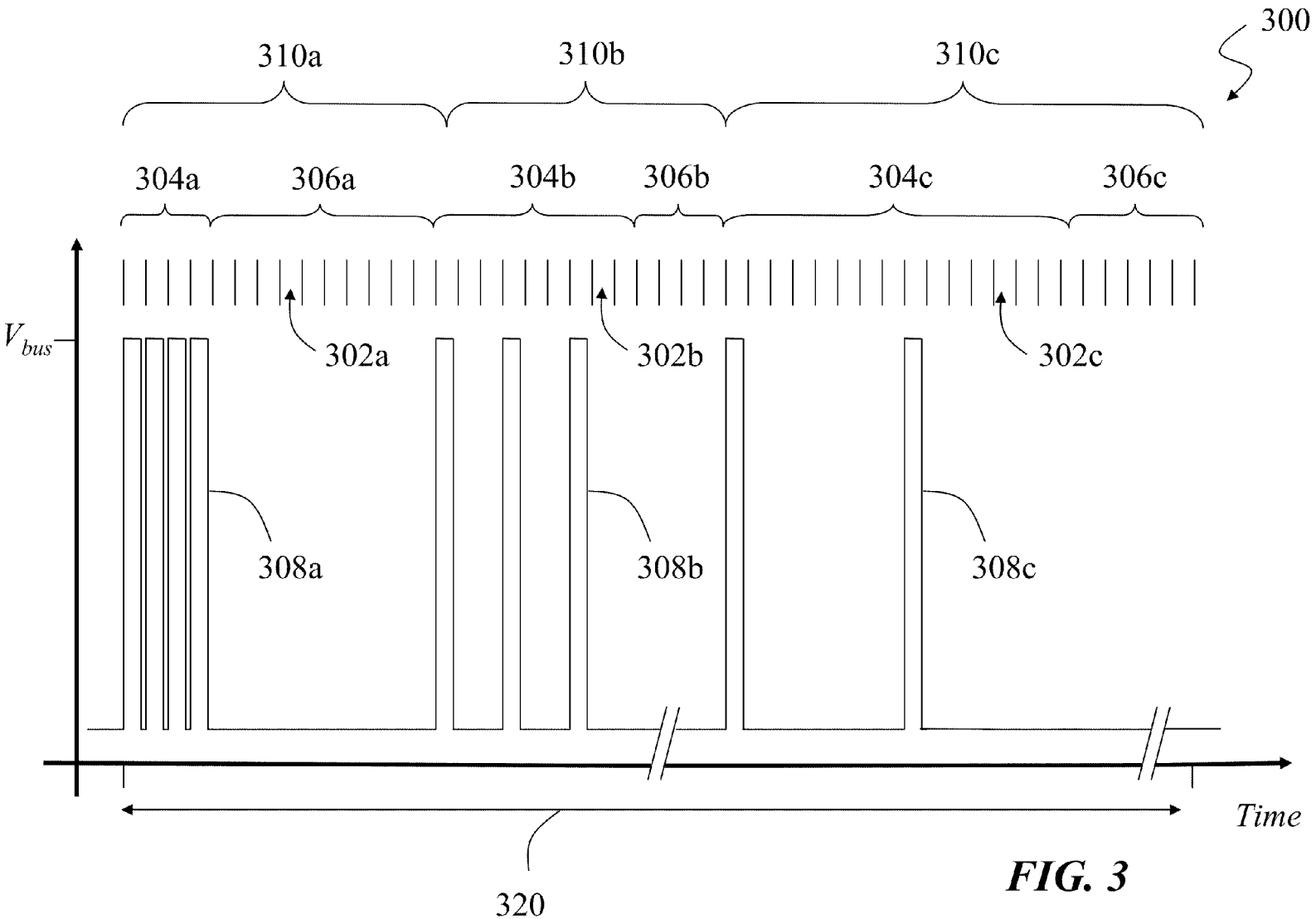
FIG. 3 is a graph that shows the voltage across a print head element over time in a printer in which the line time is divided into three segments, and in which pulses of the same length are provided in each segment.

FIG. 3 shows an example of a pulsing scheme for the print head elements according to the present invention in which three colors may be independently addressed during the time taken to print one line of an image. A graph 300 is shown that plots the voltage across a single print head element over time. In the example illustrated in FIG. 3, the average power supplied in segment 310*a* is higher than that in segment 310*b*, which in turn is higher than that in segment 310*c*. Conversely, the duration of segment 310*a* is shorter than the duration of segment 310*b*, which is shorter than the duration of segment 310*c*. The pulses supplied in segment 310*a* are therefore used to form color in the color-forming layer requiring the highest activating temperature and the shortest heating time (i.e., color-forming layer 204 in FIG. 2); the pulses supplied in segment 310*b* are used to form color in the color-forming layer requiring the intermediate activating temperature and the intermediate heating time (i.e., color-forming layer 208 in FIG. 2) and the pulses supplied in segment 310*c* are used to form color in the color-forming layer requiring the lowest activating temperature and the longest heating time (i.e., color-forming layer 212 in FIG. 2).

As discussed in detail in copending U.S. patent application Ser. No. 12/022,955, electronic pulsing techniques have been designed that allow control of the temperature of the surface of imaging member 200 without requiring modulation of the voltage of the electrical power supplied to the print head elements. This is achieved by providing many short pulses, at a constant voltage, with a frequency high enough that, given the time constant of the thermal printing head, the pulses are not individually resolved as printed dots in the thermal imaging member 200. Changing the duty cycle of these pulses changes the average power supplied to the print head element and thereby controls the temperature achieved at the top surface of the imaging member.

In a typical embodiment of the present invention, the thermal imaging member is translated at a speed of 0.1 inch/second relative to the thermal printing head, and the image resolution in the transport direction is 600 dots per inch (dpi). The time taken to print one line is therefore about 16.7 milliseconds (msec). The rate at which pulses are provided to a single print head element by the controlling circuitry of the thermal printing head is about 1 pulse per 10 microseconds (μsec). Therefore, about 1670 pulses can be provided during the time taken to print a single line of the image. Rather than adjust the duty cycle at the level of the individual pulses, it is possible to adjust the average power provided in three segments of the time taken to print a line by a choice of spacing between the pulses in each segment, each pulse having the same length.

For example, referring again to FIG. 3, each of the segments 310*a-c* is further subdivided into an on-time and an off-time. More specifically, segments 310*a-c* are divided into on-times 304*a-c* and off-times 306*a-c*. No pulses are provided in the off-time of a segment. The relative sizes of on-time and off-time portions within a segment are determined by the density of the color that is intended to be printed.

Segments 310*a-c* are divided into subintervals 302*a-c*. In one preferred arrangement, all subintervals are of equal length, and pulses may be provided in one out of every N subintervals where N is 1 in segment 310*a*, N is 6-12 in segment 310*b* and N is 15-25 in segment 310*c*.

Line interval 320 includes pulses 308*a-c*. In the particular example illustrated in FIG. 3, all of the pulses have the same amplitude and duration, although this is not required. The amplitude of all of the pulses 308*a-c* is shown in FIG. 3 as the maximum voltage $V_{bus}$. Note, however, that this is not a requirement of the present invention.

It will be appreciated that pulsing schemes such as that illustrated in FIG. 3 result in a pattern of thermal accumulation within the thermal imaging member 200 that is much more complex than would be the case for prior art, monochrome thermal printing. The effects of thermal history are correspondingly subtler, requiring modification to the prior art thermal history compensation methods. As noted above, failure to correct for the effects of thermal history can result in an incorrect color being printed, rather than merely leading to an error in the printed density of a particular color.

The above-referenced patents and patent applications disclose methods for thermal history compensation in which the following notation is used. The source image may be viewed as a two-dimensional density distribution $d_s$ having r rows and c columns. In one embodiment of the present invention, the thermal printer prints one row of the source image during each print head cycle. As used herein, the variable j will be used to designate the print head heating elements in a row of heating elements and the variable n will be used to refer to discrete time intervals (such as particular print head cycles). The temperature of the heat sink of the thermal print head at the beginning of time interval n is referred to herein as $T_s(n,j)$. Similarly, $d_s(n,j)$ refers to the density distribution of the row of the source image being printed during time interval n.

The input energy to the thermal print head may be viewed as a two-dimensional energy distribution E. Using the notation just described, E(n,j) refers to the energy to be applied to the print head elements j during time interval n. The predicted temperatures for the print head elements at the beginning of time interval n are referred to herein as $T_a(n,j)$. For the sake of simplicity, hereinafter a generic print head element will be considered and the variable j will not be explicitly indicated.

Figure 4:
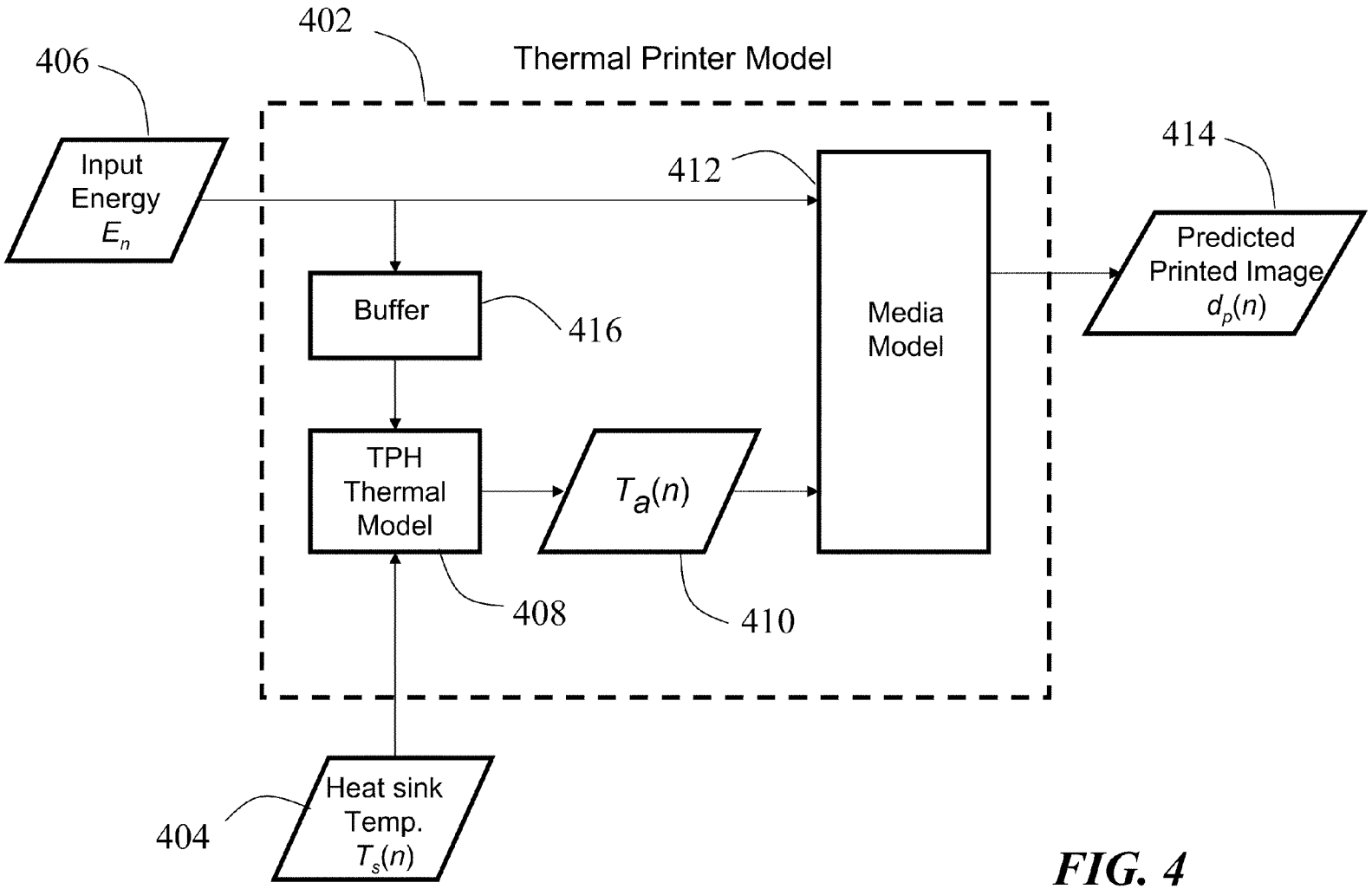
FIG. 4 is a block diagram of a thermal printer model of the prior art.

According to the methods described in the above-mentioned patents and patent applications a model of the thermal printer is constructed according to the block diagram illustrated in FIG. 4. The thermal printer model 402 takes as inputs during each time interval n: (1) the heat sink temperature $T_s(n)$ 404 of the thermal print head at the beginning of time interval n, and (2) the input energies E(n) 406 to be provided to the thermal print head elements during time interval n. The thermal printer model 402 produces as an output a predicted printed image 414, one row at a time. The predicted printed image 414 may be seen as a one-dimensional distribution of densities $d_p(n)$ at time interval n.

The thermal printer model 402 includes a print head temperature model 408 and a media density model 412. The print head temperature model 408 predicts the temperatures of the print head elements over time while the image is being printed. More specifically, the print head temperature model 408 outputs a prediction of the temperatures $T_a(n)$ 410 of the print head elements at the beginning of a particular time interval n based on the stored internal state of the layers of the TPH (determined by past inputs) and the following inputs: (1) the current heat sink temperature $T_s(n)$ 404, and (2) the input energy E(n−1) that was provided to the print head element during time interval n−1 and stored in the buffer 416. The disclosed techniques implement a thermal model for the print head that is composed of multiple layers, each having a different spatial and temporal resolution. The resolutions for the layers are chosen for a combination of accuracy and computational efficiency.

The media density model 412 takes as inputs (1) the predicted temperatures $T_a(n)$ 410 produced by the print head temperature model 408 and (2) the input energy E(n), and produces as output the predicted pixel densities of row n, $d_p(n)$ 414.

Figure 5:
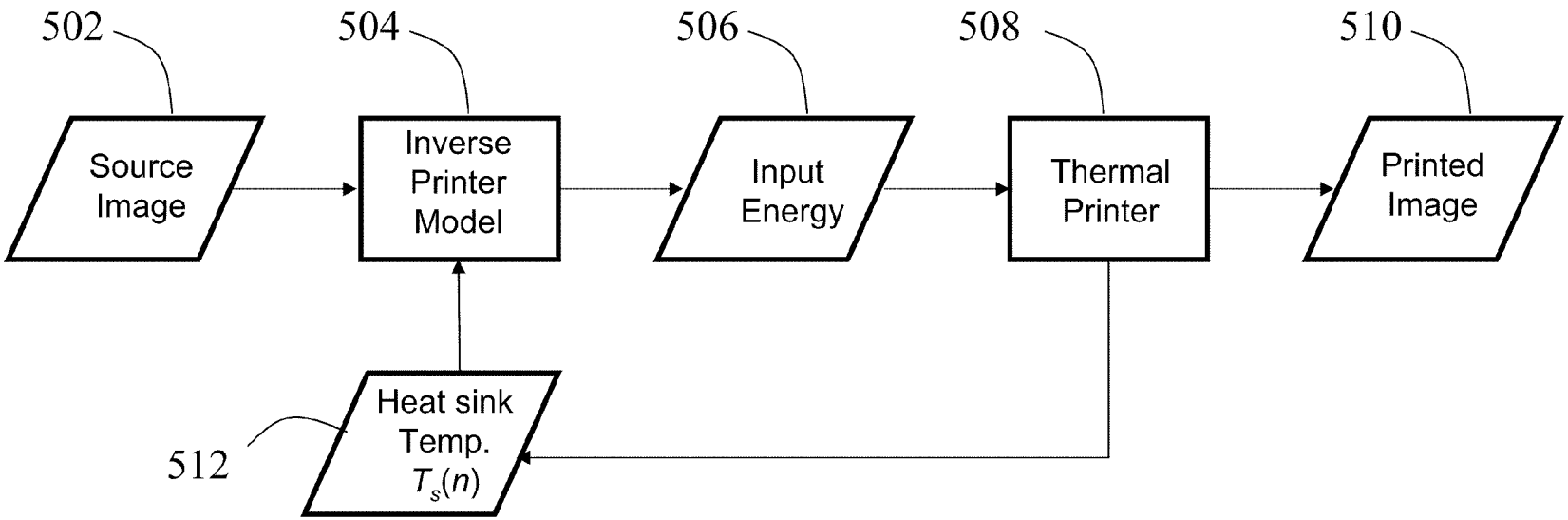
FIG. 5 is a block diagram of a thermal history compensation algorithm of the prior art and the present invention.

Thermal history compensation is achieved as shown in FIG. 5. An "inverse printer" model 504 is used to compute the energy to be supplied to an actual thermal printer 508 to produce an accurate rendering 510 of a source image 502. The inverse printer model 504 corrects the input energy 506 to the thermal print head in the thermal printer 508 by providing deviations in energy that counteract errors in density that would be predicted by running the model in the forward direction (i.e., using thermal printer model 402).

Figure 6:
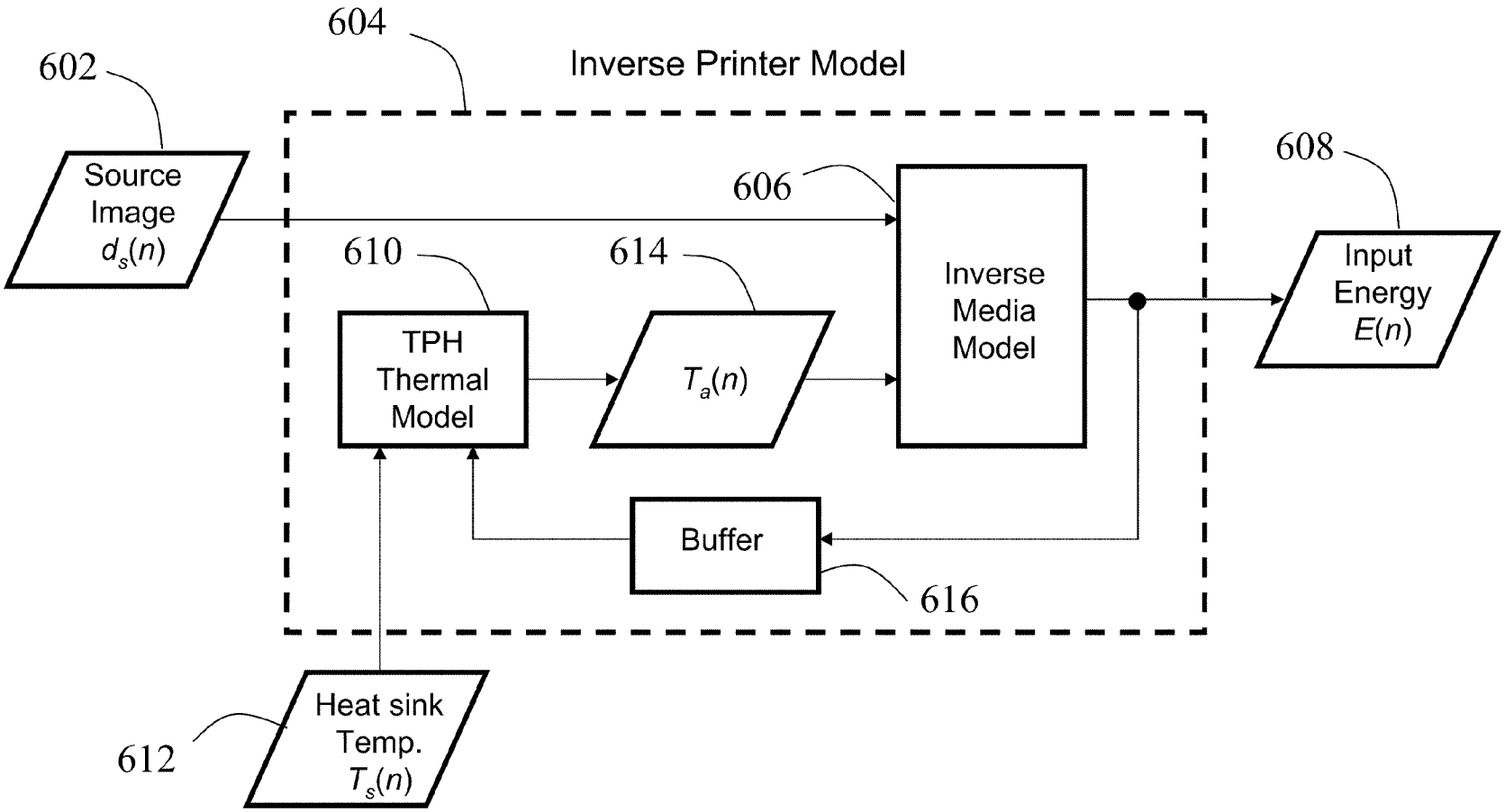
FIG. 6 is a block diagram of an inverse thermal printer model of the prior art.

FIG. 6 shows a block diagram of an inverse printer model as described in the above-mentioned patents and patent applications. The inverse printer model 604 receives as inputs for each time interval n: (1) the print head heat sink temperature $T_s(n)$ 612 at the beginning of time interval n, and (2) the densities $d_s(n)$ 602 of pixels in the row of the source image 602 to be printed during time interval n. The inverse printer model 604 produces the energy E(n) 608 (to be input to the thermal print head) as an output.

Inverse printer model 604 includes print head temperature model 610 and inverse media density model 606. The print head temperature model has already been described (in general terms) above.

The inverse media density model 606 computes the amount of energy E(n) 608 to provide to each of the print head elements during time interval n based on: (1) the predicted temperatures $T_a(n)$ 614 of each of the print head elements at the beginning of time interval n, and (2) the desired densities $d_s(n)$ 602 to be printed on the thermal imaging member during time interval n. The input energy E(n) 608 is provided to a buffer 616 for use in the print head temperature model 610 during the next time interval, n+1.

The transfer function defined by the inverse media model 606 is a two-dimensional function $E=F(d,T_a)$. In non-thermal printers, the transfer function relating input energy E and output density d is typically a one dimensional function $d=\Gamma(E)$, referred to herein as a gamma function. In thermal printers, such a gamma function is not unique because the output density d is dependent not only on the input energy E but also on the current thermal print head element temperature. In the above-mentioned patents and patent applications, the function $E(n)=F(d,T_a)$ described above is represented using the form shown by Equation 1:

$$E=\Gamma^{-1}(d)+S(d)(T_a-T_o(d)) \quad \text{Equation 1}$$

This equation may be interpreted as the first two terms of a Taylor series expansion in $(T_a-T_o(d))$ for the exact energy that would provide the desired density, where $T_o(d)$ is the print head element temperature, while printing density d, at which the function $\Gamma(E)$ was measured. In Equation 1, $\Gamma^{-1}(d)$ is the inverse of the function $\Gamma(E)$ described above, and S(d) is a temperature sensitivity function which may take any form, one example of which is described in more detail below. Note that Equation 1 represents the two-dimensional function $E=F(d,T_a)$ using three one-dimensional functions of density: $\Gamma^{-1}(d)$, S(d), and $T_o(d)$. Equation 1 may be rewritten as Equation 2:

$$E=\Gamma^{-1}(d)-S(d)T_o(d)+S(d)T_a \quad \text{Equation 2}$$

The term $\Gamma^{-1}(d)-S(d)T_o(d)$ may represented and stored as a single one-dimensional function G(d), so that Equation 2 may be rewritten as:

$$E=G(d)+S(d)T_a \quad \text{Equation 3}$$

G(d) corresponds to the inverse gamma function at a reference print head element temperature of zero, and S(d) is the sensitivity of the inverse gamma function to temperature at a fixed density. In practice, the value of E may be computed using Equation 3 using two lookup tables: G(d) and S(d), based on the value of d.

In the discussion of multi-color printing that follows, C denotes the total number of colors printed within one line time. The set $C=\{0,\ldots,C-1\}$ contains the C color indices. As before, n denotes the line number. Each line is divided into C time segments, not necessarily of equal duration, corresponding to each color in the set C.

As described above with reference to FIG. 3, the manner in which the input energy to be provided to each print head element is selected may be varied for each of the segments. For example, although a single thermal model may be used to predict the temperature of the print head elements in each of the segments, different parameters may be used in the different segments. Similarly, different energy computation functions may be used to compute the energy to be provided to the print head in each of the segments based on the predicted print head element temperature.

For example, techniques are described in U.S. Pat. No. 7,298,387 for predicting the temperature of the print head elements at the beginnings of successive time steps of unequal duration and for computing the energies to provide to the print head elements based on properties of the particular color-forming layer on which the print head elements are printing. Both techniques may be combined with each other, thereby providing the ability to perform thermal history control in a printer that is capable of printing sequentially on multiple color-forming layers using printing segments of unequal durations.

The previously disclosed techniques rely upon inverse media density functions of the form described in Equation 3 that are specific to particular colors:

$$E_c(n_c)=G_c(d_c,n_c)+S_c(d_c,n_c)T_a(n_c),\ \forall c\in C \quad \text{Equation 4}$$

Such functions, however, have limitations when printing more than one color sequentially in one line of an image in a single pass of a thermal printing head.

It was noted above that a gamma function $d=\Gamma(E)$ is not unique in thermal printers because the output density d is dependent not only upon the input energy E but also upon the current thermal print head element temperature. The output density will also be dependent upon the starting temperature of the thermal imaging member, which can be treated as a constant for prior art, monochrome printing but which will be variable when more than one superimposed color is printed within a single line time.

Figure 7:
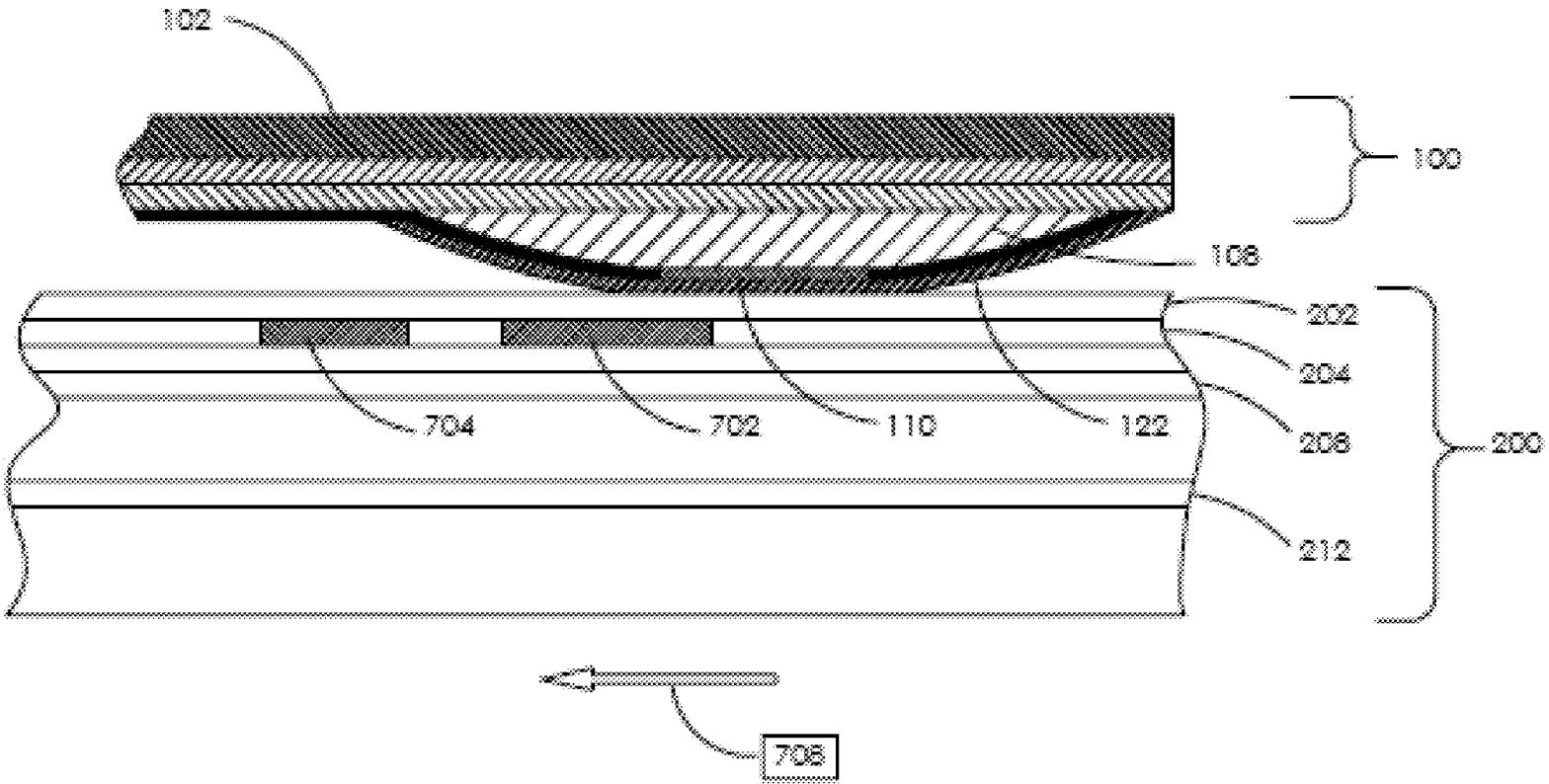
FIG. 7 is a partially schematic, side sectional view of a thermal printing head addressing a single color of a thermal imaging member according to the invention.

The discussion that follows is intended to clarify this important difference between the methods of the present invention and those of the prior art. FIG. 7 shows the case in which a thermal printing head 100 is printing a single color onto a thermal imaging member 200 that is being translated in the direction of arrow 708. Print head element 110 heats thermal imaging member 200 through print head overcoat layer 122 and thermal imaging member overcoat layer 202, to produce dots 702 and 704 in color-forming layer 204. In this situation, successive dots are printed onto portions of thermal imaging member 200 that have not previously been heated by thermal print head 100, and the starting temperature of the thermal imaging member can be treated as a constant (during the time taken to print the image) and accounted for as described in the above-mentioned patents and patent applications. In such a case an inverse media density model in the form of Equation 3 can be used.

Figure 8:
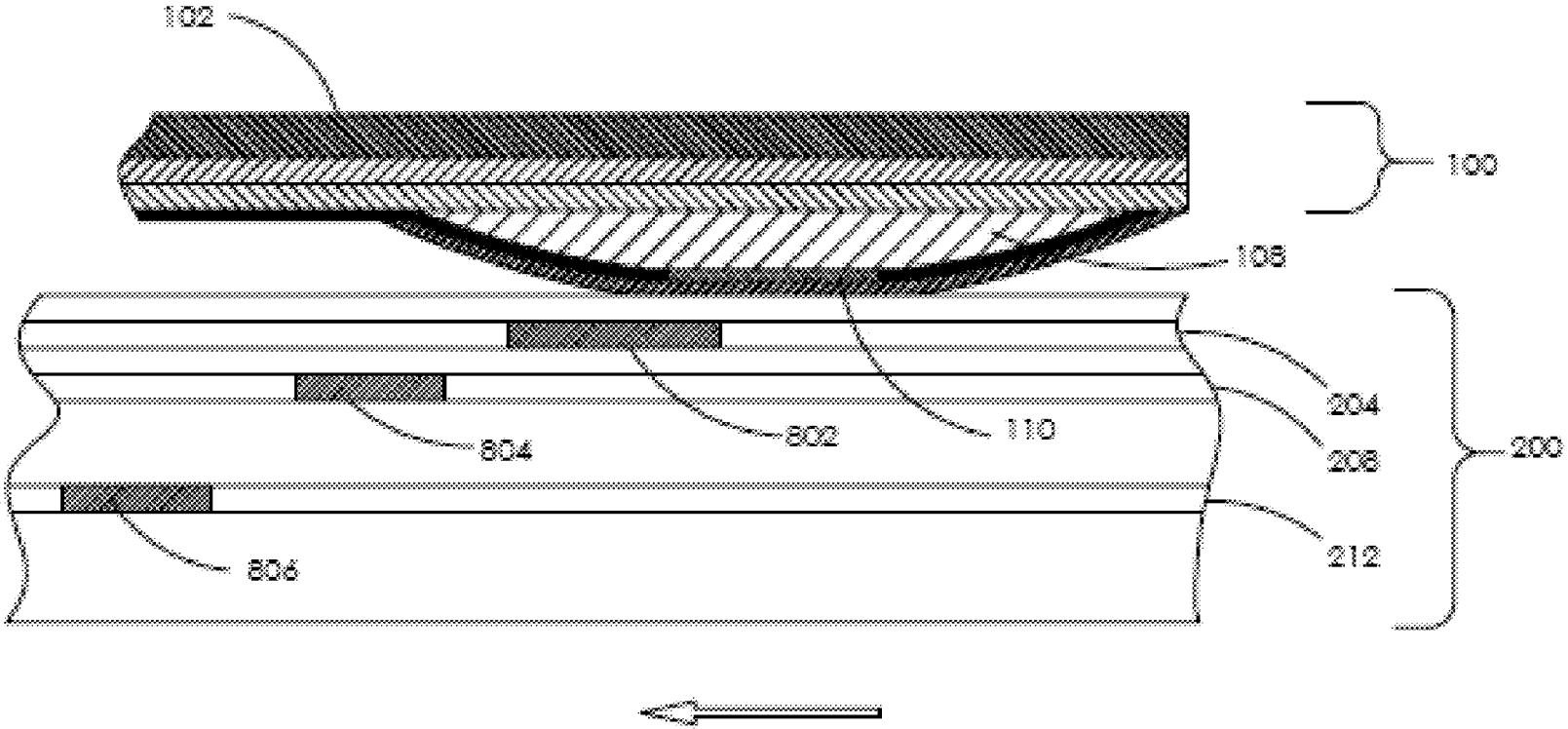
FIG. 8 is a partially schematic, side sectional view of a thermal printing head addressing multiple colors of a thermal imaging member according to the invention wherein the images in different colors are not superimposed.

The methods discussed above are also adequate for the situation illustrated in FIG. 8, in which successive dots 802, 804 and 806 are printed in different color-forming layers (204, 208 and 212, respectively) but do not overlap in a vertical direction.

Figure 9:
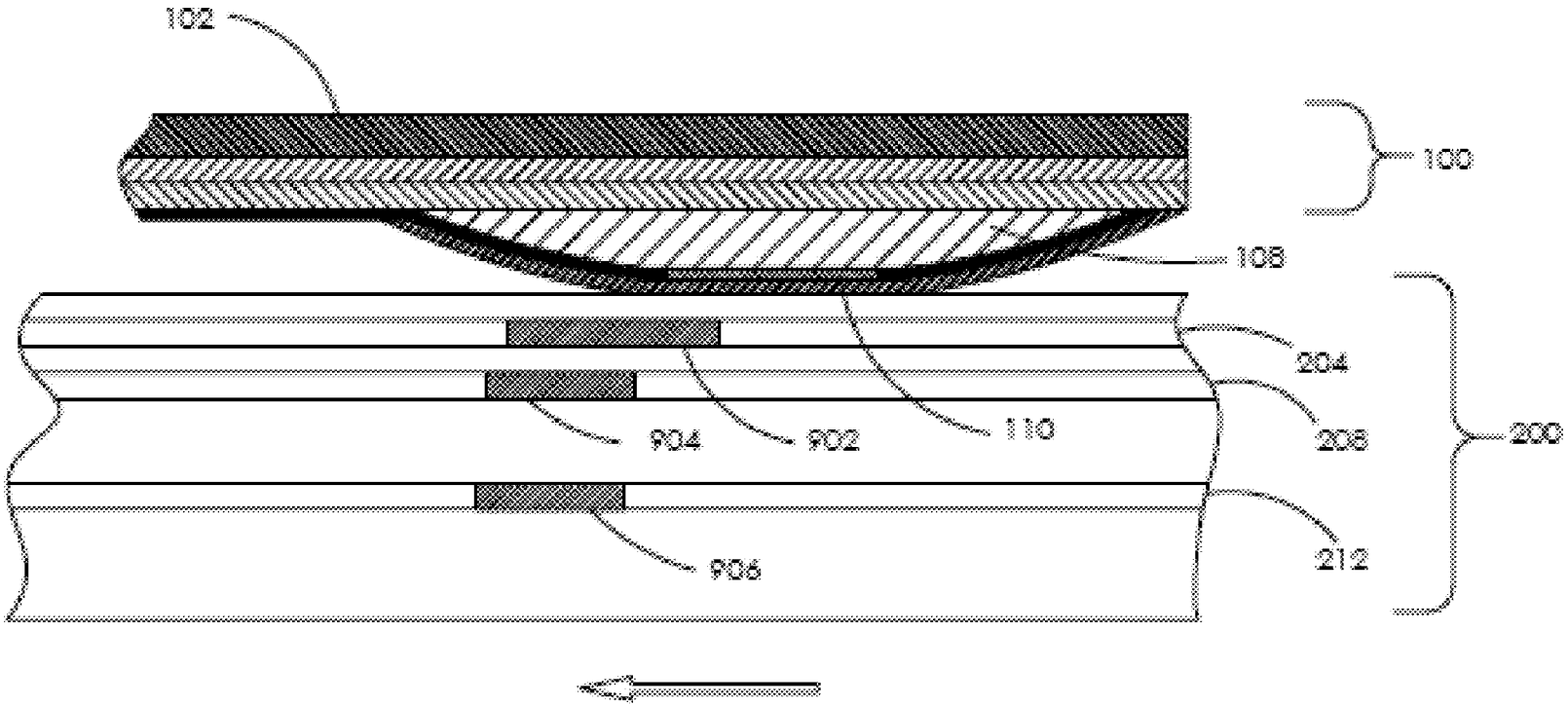
FIG. 9 is a partially schematic, side sectional view of a thermal printing head addressing multiple colors of a thermal imaging member according to the invention wherein the images in different colors are superimposed.

The situation shown in FIG. 9, however, is different in that dots 902, 904 and 906 (in color-forming layers 204, 208 and 212, respectively) are superimposed: i.e., they overlap in a vertical direction. Such dots may be printed using a pulsing scheme such as that illustrated in FIG. 3. If it is assumed, with reference to FIG. 9, that dot 906 is printed before dot 904, which in turn is printed before dot 902, then the heat that was transferred to the thermal imaging medium when printing dots 906 and 904 will have caused the baseline temperature of color-forming layer 204 to be higher than it would have been in the absence of such printing. It is therefore necessary for the media density model to incorporate the energy that was input in printing all the colors previous to the color under consideration in the time elapsed since printing that color in the previous line. In other words, just as the print head thermal model must account for prior heating of the TPH, the media model must account for prior heating of a region of the thermal imaging member that is to be printed on again.

Figure 10:
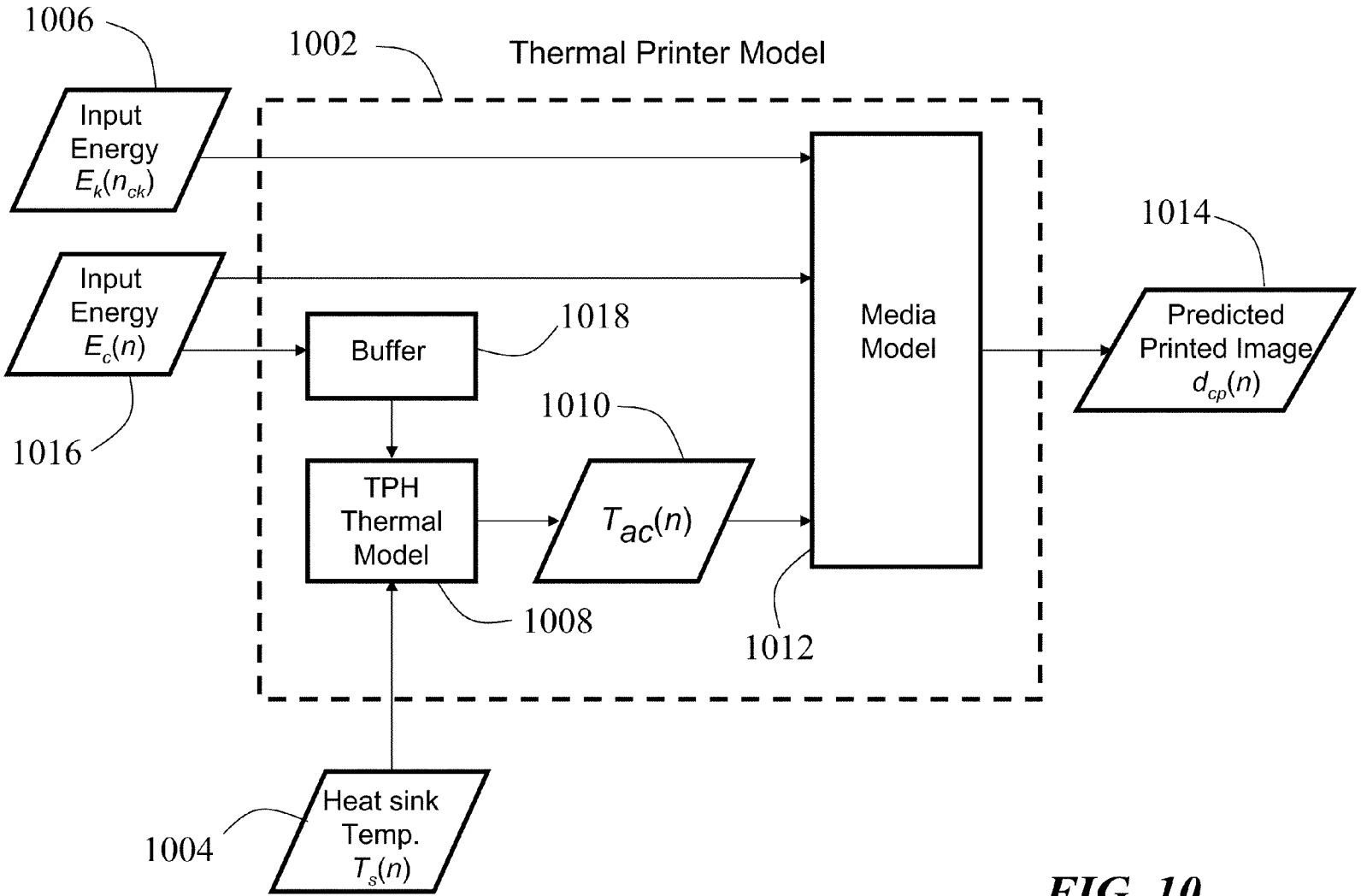
FIG. 10 is a block diagram of a thermal printer model of the present invention.

FIG. 10 shows a thermal printer model according to the present invention. The thermal printer model 1002 takes as inputs during each time interval n: (1) the heat sink temperature $T_s(n)$ 1004 of the thermal print head at the beginning of time interval n, (2) the input energy $E_c(n)$ 1016 to be provided to the thermal print head elements during time interval n to print color c, and (3) the input energy $E_k(n_{ck})$ 1006 that were supplied when printing colors k≠c (i.e., the remaining colors other than c) in line(s) number(s) $n_{ck}$. Line(s) number(s) $n_{ck}$ are defined as $n_c$ when color number k<c and $n_{c-1}$ when k>c.) The thermal printer model 1002 produces as an output a predicted printed image in color c, $d_{cp}(n)$ 1014, one row at a time.

The thermal printer model 1002 includes a print head temperature model 1008 and a media density model 1012, each of which is described in more detail below.

The print head temperature model 1008 predicts the temperatures of the print head elements over time while the image is being printed. It does this by internally tracking the state of the different layers of the TPH by taking into account all the energies supplied to the print head elements in the past. More specifically, the print head temperature model 1008 outputs a prediction of the temperatures $T_{ac}(n)$ 1010 of the print head elements at the beginning of the segment of a particular time interval n during which color c is printed based on the stored internal state of the different layers of the TPH and the following inputs: (1) the current heat sink temperature $T_s(n)$ 1004, and (2) the input energy that was supplied when printing the most recent previous color (in the most recent previous segment), stored in single-element buffer 1018.

The media model 1012 takes as inputs (1) the predicted temperatures $T_{ac}(n)$ 1010 produced by the print head temperature model 1008, (2) the input energy $E_c(n)$, and (3) the input energies $E_k(n_{ck})$ 1016 that were supplied when printing colors k≠c in line(s) number(s) $n_{ck}$ (i.e., the energies supplied when printing other colors since the printing of color c in the previous line printing interval, n−1). Media model 1012 produces as output the predicted printed image 1014.

Figure 11:
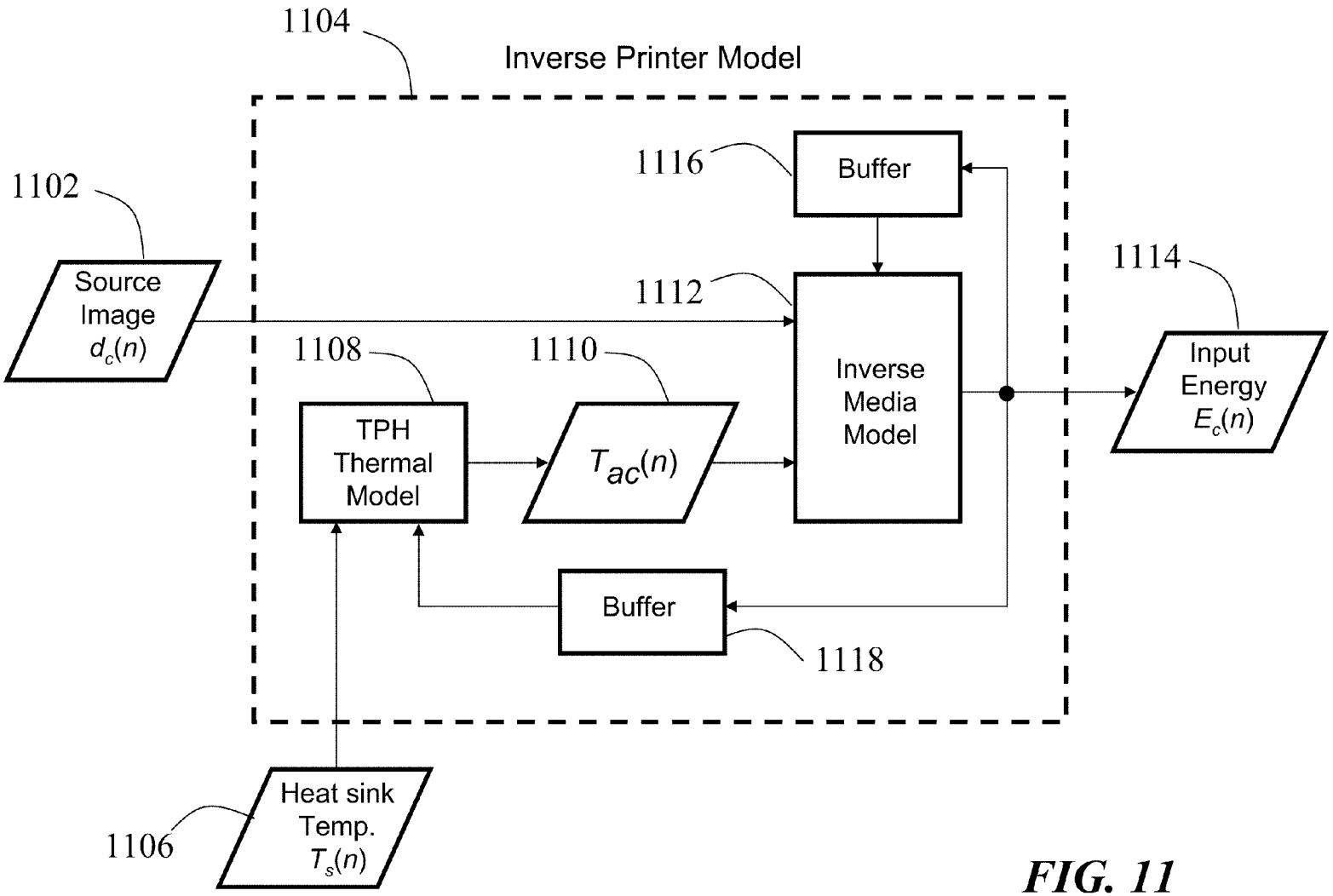
FIG. 11 is a block diagram of an inverse printer model of the present invention.

FIG. 11 shows a block diagram of an inverse printer model of the present invention. The inverse printer model 1104 receives as inputs for each time interval n: (1) the print head heat sink temperature $T_s(n)$ 1106 at the beginning of time interval n, and (2) the densities $d_c(n)$ 1102 of color c in the row of the source image to be printed during time interval n. The inverse printer model 1104 produces the energy $E_c(n)$ 1114 (to be input to the thermal print head) as an output.

Inverse printer model 1104 includes print head temperature model 1108 and inverse media model 1112. The print head temperature model has already been described (in general terms) above with reference to FIG. 10, and is described in further detail below.

The inverse media model 1112 computes the amount of energy $E_c(n)$ 1114 to provide to each of the print head elements during time interval n based on: (1) the predicted temperatures $T_{ac}(n)$ 1110 of each of the print head elements at the beginning of the segment for printing color c in time interval n, (2) the desired densities $d_c(n)$ 1102 to be output by the print head elements during time interval n, and (3) the input energies $E_k(n_{ck})$ 1016 that were supplied when printing colors k≠c in line(s) number(s) $n_{ck}$. These input energies are stored in a (C−1)-element buffer 1116. Input energies $E_c(n)$ 1114 are provided to buffer 1118 for use by the print head temperature model 1108 during the next time interval, n+1, and to buffer 1116 for use during the printing of the next color. Note that the block diagram shown in FIG. 11 refers to a single pixel. In the discussion that follows with reference to FIG. 12 it will be clarified how a line of pixels may be treated according to the methods of the present invention.

Although in the embodiment just described, the input energies $E_c(n)$ 1114 are stored in the (C−1)-element buffer 1116, this is merely an example and does not constitute a limitation of the present invention. The same or similar functions may be performed in other ways. For example, values other than the input energies $E_c(n)$ 1114 may be stored in the (C−1)-element buffer 1116. For example, a function of each of the input energies $E_c(n)$ 1114 may be stored in the (C−1)-element buffer 1116. As another example, a function of all of the input energies $E_c(n)$ 1114 may be stored in the buffer, so that the buffer 1116 may be a one-element buffer rather than a (C−1)-element buffer.

Inverse media model 1112 requires modification from Equation 3 as follows:

$$E_c(n_c) = \Gamma_c^{-1}(d_c) + S_c(d_c)(T_{ac}(n_c) - T_{oc}(d_c)) + \sum_{k \neq c} \Delta S_{ck}(d_c) E_k(n_{ck}),\ \forall\, c \in C \qquad \text{Equation 5}$$

where $E_k(n_{ck})$ refers to the energy supplied when printing color k in line number $n_{ck}$. Line number $n_{ck}$ is defined as $n_c$ when color number k<c and $n_{c-1}$ when k>c. The terms $T_{ac}(n_c)$ and $T_{oc}(d_c)$ refer, respectively, to the print head element starting temperature when printing color c at line $n_c$ and the print head element temperature, while printing density $d_c$, at which the gamma function was parameterized. The terms $\Delta S_{ck}(d_c)$ that control the correction to the energy needed to print color c when the energy that was supplied when printing other colors (k) is non-zero are called the residual cross energy sensitivities of color c to colors k. The term $\Gamma_c^{-1}(d_c)$ is defined as the energy to produce density $d_c$ when the energies previously applied to the other colors are zero and the print head element temperature is equal to $T_{oc}(d_c)$. Analogously to Equation 3, above, Equation 5 may be rewritten as:

$$E_c(n_c) = G_c(d_c) + S_c(d_c)T_{ac}(n_c) + \sum_{k \neq c} \Delta S_{ck}(d_c)E_k(n_{ck}),\ \forall\ c \in C \quad \text{Equation 6}$$

where $G_c(d_c)$ corresponds to the inverse gamma function for printing color c at a reference print head element temperature of zero, $S_c(d_c)$ is the sensitivity of that inverse gamma function to temperature at a fixed density, and the $\Delta S_{ck}(d_c)$ terms are residual cross energy sensitivities of color c to colors k, as discussed above. In practice, the value of $E_c(n_c)$ may be computed using Equation 5 using lookup tables for $G_c(d_c)$, $S_c(d_c)$, and $\Delta S_{ck}(d_c)$ based on the value of $d_c$.

Equations 5 (and 6) are derived as follows. The energy $E_c$ required for printing a desired density $d_c$ is a function of the present temperature of the print head element $T_{ac}$, the energy supplied to the other colors in the immediate past and the desired density:

$$\begin{aligned} E_c(n_c) &= f_c(d_c, T_{ac}, \{E_k(n_{ck}):k \neq c\}) \quad \text{Equation 7} \\ &\approx \Gamma_c'^{-1}(d_c) + \frac{\partial f_c(d_c, T_{ac}, \{E_k(n_{ck}):k \neq c\})}{\partial T_{ac}} \\ &\quad (T_{ac}(n_c) - T_{oc}(d_c)) + \\ &\quad \sum_{k \neq c} \frac{\partial f_c(d_c, T_{ac}, \{E_k(n_{ck}):k \neq c\})}{\partial E_k} \\ &\quad (E_k(n_{ck}) - \Gamma_{ck}^{-1}(d_c)) \\ &= \Gamma_c'^{-1}(d_c) + S_c(d_c)(T_{ac}(n_c) - T_{oc}(d_c)) + \\ &\quad \sum_{k \neq c} \Delta S_{ck}(d_c)(E_k(n_{ck}) - \Gamma_{ck}^{-1}(d_c)) \end{aligned}$$

where the approximation is a first order Taylor series expansion around $\Gamma_{ck}^{-1}(d_c)$, $k \neq c$ (the energies applied to other colors) and $T_{oc}(d_c)$ (defined as described above). Equation 7 becomes the same as Equation 5 when $$\Gamma_c'^{-1}(d_c) = \Gamma_c^{-1}(d_c) + \sum_{k \neq c} \Delta S_{ck}(d_c)\Gamma_{ck}^{-1}(d_c).$$

In this case the interpretation of the function $\Gamma'_c{}^{-1}(d_c)$ is the inverse gamma function for color c parameterized with non-zero energies for printing of colors other than c, $\Gamma_{ck}{}^{-1}(d_c)$ (i.e., non-zero cross energies). Note that the energy computed by Equation 6 may be viewed as a function of density, temperature, and previously-provided energies, as illustrated by the first line of Equation 7.

Figure 12:
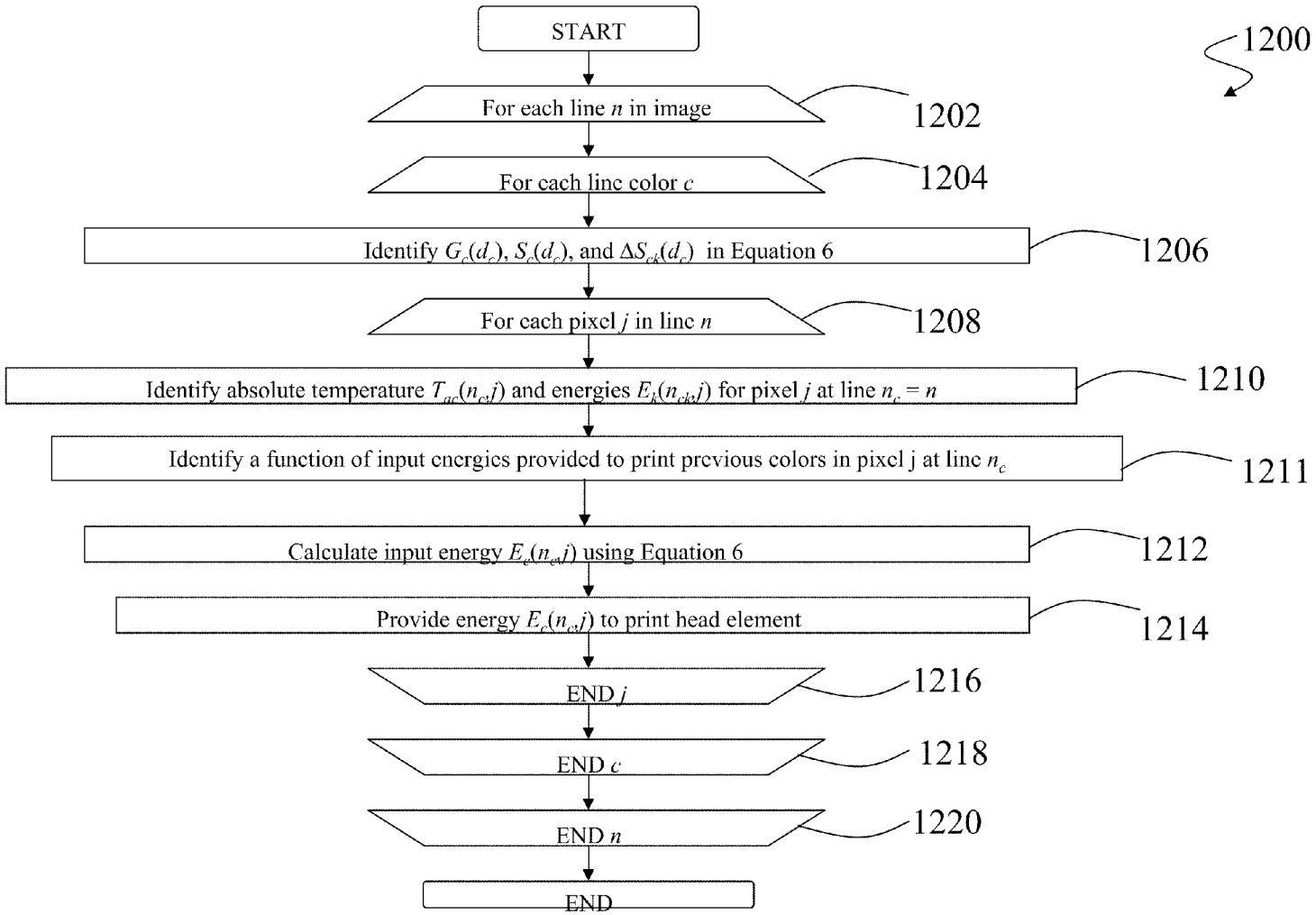
FIG. 12 is a flowchart of a method performed in embodiments of the present invention to perform thermal history control on a digital image

Preferred methods for performing thermal history compensation according to the present invention will now be described in more detail, with particular reference to the three-color case. Referring to FIG. 12, a flowchart is shown of a method 1200 that is performed in one embodiment of the present invention to perform thermal history control on a digital image. The method 1200 may vary the energy computation function that is used to calculate the input energy to provide to the print head elements during each of a plurality of pixel-printing time segments according to the color being printed. The segments may, for example, be of unequal duration, as in the case of the segments 310*a-c* shown in FIG. 3.

The method 1200 enters a loop over each line n in the image to be printed (step 1202). The method 1200 then enters a loop over each color c, corresponding to the various printing segments of the current line n (step 1204).

In one embodiment of the present invention, each of the segments is associated with a possibly distinct energy computation function. The different energy computation functions, in one embodiment of the present invention, have the form of Equation 6 above. The method 1200 identifies the parameters used in Equation 6 for color c: $G_c(d_c)$, $S_c(d_c)$, and terms $\Delta S_{ck}(d_c)$ for all colors other than c (step 1206).

The method 1200 enters a loop over each pixel j in line n (step 1208). In one embodiment of the present invention, a thermal model is provided for predicting the temperature of print head elements at the beginning of pixel-printing segments. Such a thermal model may, for example, be implemented in the manner described in the above-referenced patent applications. In one embodiment of the present invention, each pixel-printing segment is associated with a possibly distinct set of thermal model parameters, as described in U.S. Pat. No. 7,298,387.

Returning to FIG. 12, the method 1200 uses the thermal model parameters associated with segment c to predict the absolute temperature $T_{ac}(n_c,j)$ of the print head element that is to print color c in pixel j of line $n_c$ (step 1210).

In another embodiment of the present invention, the temperature $T_{ac}(n_c,j)$ of the print head element that is to print color c in pixel j of line n may be estimated by use of a measurement. For example, the resistance of the print head element may be measured, and this value may be used to estimate the temperature of the print head element.

In step 1210 of method 1200 there are also identified the energies $E_k(n_{ck},j)$ that were used to print colors other than c since the time that color c was printed in line $n_c$-1. The method 1200 also identifies a function of the input energies previously provided to colors in pixel j at line n (step 1211).

The method 1200 next computes the input energy $E_c(n_c,j)$ based on the print density $d_c(n_c,j)$, the absolute print head element temperature $T_{ac}(n_c,j)$, and the energies supplied to previous colors $E_k(n_{ck},j)$ according to Equation 6 (step 1212).

The method 1200 provides the computed energy $E_c(n_c,j)$ to the appropriate print head element within the duration of the segment of line n corresponding to color c (step 1214).

The method 1200 repeats steps 1210-1214 for the remaining pixels in the current line n (step 1216).

The method 1200 repeats steps 1206-1216 for the remaining colors in the current line n (step 1218).

The method 1200 repeats steps 1204-1218 for the remaining lines in the image to be printed (step 1220). The method 1200 thereby performs thermal history control on the whole digital image.

As illustrated by the preceding description, the method 1200 may take into account the different thermal characteristics of the different color-forming layers of the print medium when selecting the energy computation function (step 1206) and may adjust the energy supplied when printing a particular color for the energies that were supplied when printing other colors (steps 1210 and 1212).

As further described in the above-referenced patents, additional parameters may be added to the energy computation function, such as the ambient printer temperature and the relative humidity (RH) to take such quantities into account when computing the input energy.

With the modifications described above, the thermal history control algorithm maintains a running estimate of the temperature profile of the thermal print head and applies the appropriate thermal corrections to the energies applied to the heaters while writing on each of the color-forming layers. As is apparent from the description herein, the method may be used in conjunction with any number of color-forming layers.

It will be clear to one of ordinary skill in the art that effective methods must be provided for estimation of the parameters introduced in Equation 5 if it is to provide a useful basis for thermal history compensation.

In general, the parameters are estimated experimentally, by printing a certain image using the thermal printer 100 and thermal imaging member 200 and measuring the result. In practice, in a preferred embodiment of the present invention, this is done by applying a constant energy to the print head elements and printing in a steady state, and repeating this process with different power levels or on-times (which amounts to different energies) for the different colors that are to be printed. It is critically important to separate the media model parameters from those of the thermal model, and printing in a steady state makes this possible, as is shown below. As used herein, the term "steady state" refers to the condition in which the printer produces a substantially constant printed density of color c when the energies supplied to the thermal printing head are constant and the heat sink temperature remains substantially constant.

The temperature of the thermal print head element at line n of color c can be estimated using the thermal model as described in detail in U.S. Pat. Nos. 6,819,347 and 7,298,387. The model is linear, so the general equation can be written:

$$T_{ac}(n) = T_s + \sum_{k=0}^{c-1} \Theta_{ck}(n) E_k \qquad \text{Equation 8}$$

where $\Theta_{ck}(n)$ is a scaling factor with units $K \cdot cm^2 \cdot J^{-1}$ corresponding to the temperature rise of the heating element at the start of color c in line n due to unit energy applied at color k for n−1 lines. $\Theta_{ck}(n)$ depends upon the parameters of the thermal model (i.e., the model that predicts the temperature of the heating element of the TPH).

Recall that the inverse gamma function $\Gamma_c^{-1}(d_c)$ in Equation 5 is defined as the steady state energy that needs to be supplied to the print head to produce density $d_c$ in color c when the energies supplied to print other colors are zero. The operating temperature $T_{oc}(d_c)$ is given by substituting $E_c = \Gamma_c^{-1}(d_c)$ and $E_k = 0$, $k \neq c$ in Equation 8:

$$T_{oc}(d_c) = T_\Gamma + \Theta_{cc}\Gamma_c^{-1}(d_c) \qquad \text{Equation 9}$$

Where $T_\Gamma$ is the reference heat sink temperature for $\Gamma_c(d_c)$. Note that in steady state printing n>>1 and $\Theta_{cc}(n)$ becomes a quantity independent of n.

The steady state media model is obtained by substituting Equations 8 (for $T_{ac}$) and 9 (for $T_{oc}$) into Equation 5, as follows:

$$\begin{aligned} E_c &= \Gamma_c^{-1}(d_c) + S_c(d_c)\Big(T_s + \sum_k \Theta_{ck} E_k - T_\Gamma - \Theta_{cc}\Gamma_c^{-1}(d_c)\Big) + \sum_{k \neq c} \Delta S_{ck}(d_c) E_k \\ &= \Gamma_c^{-1}(d_c) + S_c(d_c)\Big(T_s + \Theta_{cc} E_c + \sum_{k \neq c} \Theta_{ck} E_k - T_\Gamma - \Theta_{cc}\Gamma_c^{-1}(d_c)\Big) + \sum_{k \neq c} \Delta S_{ck}(d_c) E_k \\ &= \Gamma_c^{-1}(d_c) + S_c^e(d_c)\Delta T_s + \sum_{k \neq c} S_{ck}^e(d_c) E_k, \ \forall\, c \in C \end{aligned} \qquad \text{Equation 10}$$

where $\Delta T_s = T_s - T_\Gamma$; $S_c^e(d_c)$ is the effective temperature sensitivity that controls the correction to the steady state energy when $T_s$ is different from $T_\Gamma$, and is defined:

$$S_c^e(d_c) = \frac{S_c(d_c)}{1 - \Theta_{cc} S_c(d_c)} \qquad \text{Equation 11}$$

and $S_{ck}^e(d_c)$ is an effective cross energy sensitivity that is given as:

$$S_{ck}^e(d_c) = \Theta_{ck} S_c^e(d_c) + \frac{\Delta S_{ck}(d_c)}{1 - \Theta_{cc} S_c(d_c)} \qquad \text{Equation 12}$$

The two components of $S_{ck}^e(d_c)$ arise as follows. The first component can be traced back to the thermal model in which the energy applied to a previous color results in a rise of the head element temperature and in turn affects the energy applied to the color under consideration. The second component's origin is in the media model of Equation 5 where the energy applied to another color in the immediate past is explicitly accounted for.

The breakup of Equation 12 into two components serves to illustrate the advantage of the media model of the present invention for the case of multicolor printing in a single pass. In a generalized single-color model of the prior art the cross energy sensitivity would arise only from the thermal model and would be $\Theta_{ck} S_c^e(d_c)$. By using Equation 12, cross energy sensitivity due to the media response can be independently estimated using $\Delta S_{ck}(d_c)$.

As described above, the approach to parameter estimation is first to formulate a forward, predictive printer model driven by the same set of parameters as the inverse model that is used in thermal history compensation. Such a forward model is capable of predicting output densities for a particular set of input energies based on the model parameters. The media model required in a forward printer model, as shown in FIG. 10, has energy as an input, and an output that is a density that satisfies Equation 5. This may be a more difficult problem than the (inverse) media model with density as an input and energy as an output, since it has no closed form solution. Iterative numerical methods are needed to solve this (non-linear) problem. The thermal state of the print head is also required to be known, and this can be estimated by use of the thermal model.

Once the forward printer model is formulated, the parameters can be estimated by providing richly varied set of energies to both the actual printer and the forward printer model. The heat sink temperature of the actual printer is monitored during printing, and the output densities of the actual print are measured. The same set of energies and recorded heat sink temperature are fed into the forward printer model. The difference between the model's output densities and the measured densities is fed back to adjust the parameters of the model and improve the agreement between model and measurement.

To improve the estimation of the model parameters, the set of energy inputs chosen to probe printer response should be such that the entire density space is sampled. This is hard to do without actually knowing the response of the printer. One method for improving this sampling is to use the inverse printer model with an initial set of parameters to produce the set of input energies. With an initial round of data collected in this fashion, the estimate of the parameters can be refined and a new set of energies can be produced to generate a new set of data. This process can then be iterated until an acceptable level of performance is achieved.

Figure 13:
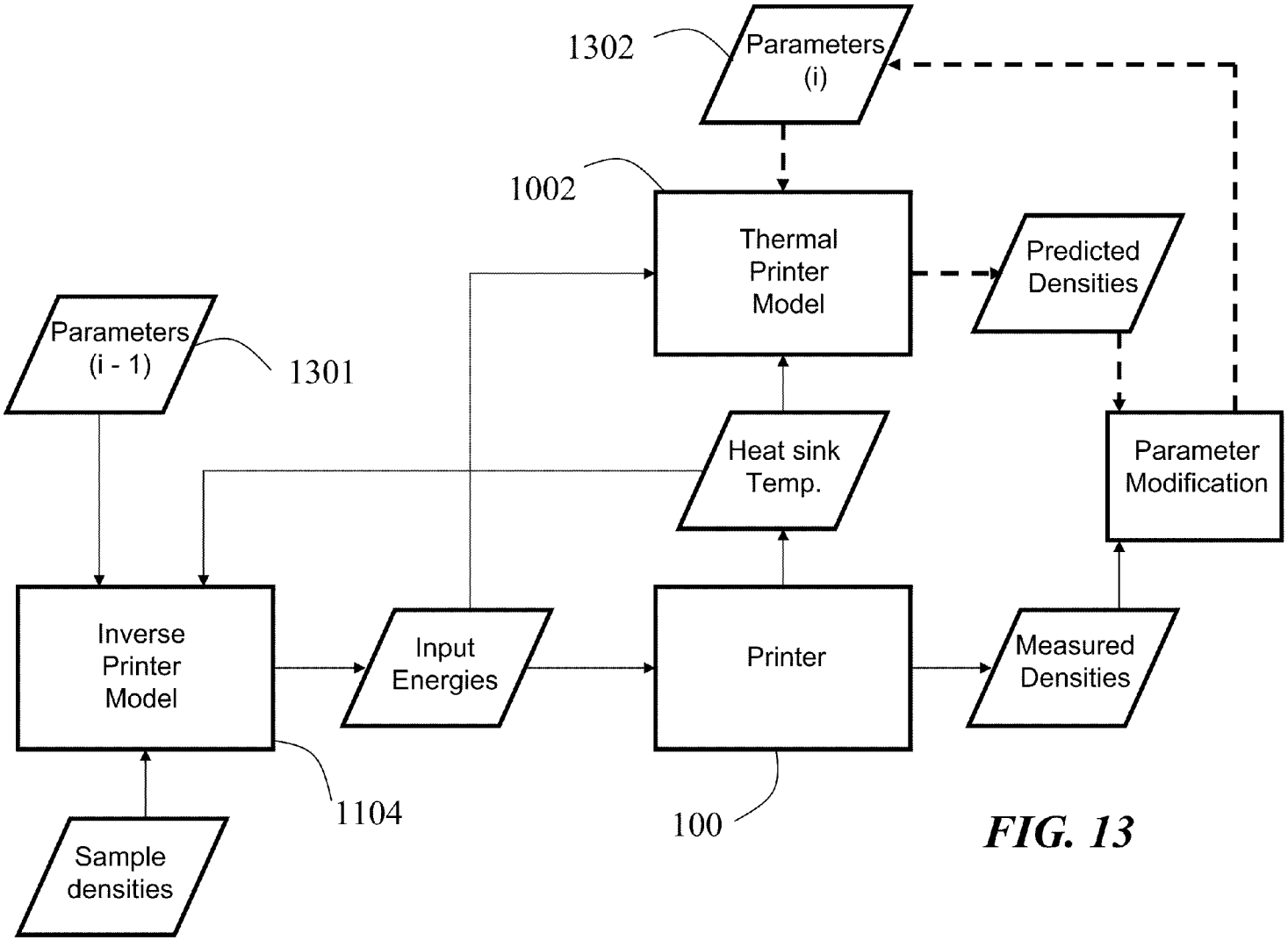
FIGS. 13, 14 and 15 are block diagrams of methods for parameter estimation for use in the methods of the present invention.

FIG. 13 shows a schematic of this method where the inverse printer model 1104 of the present invention is running with a previous estimate of the parameters 1301 (iteration index i−1). The energies output by the inverse printer model 1104 are fed to both the actual printer 100 and the thermal printer model 1002 of the present invention. The difference between the outputs of printer 100 and model 1002 are used to produce a new set of parameters 1302 (iteration index i). Note that all parameters (corresponding to both the media model and the thermal model) are included in this set.

Even though the method outlined in FIG. 13 appears conceptually simple, in practice it is fraught with difficulties. The dimensionality of the parameter space is quite high, given that a total of C+1 one-dimensional functions are required per color, in addition to all the thermal parameters. This high dimensionality coupled with the fact that the thermal and media model parameters interact with each other make the parameter estimation a challenging optimization problem. Another difficulty is the presence of local minima in the error surface, which is a highly non-linear function of the unknown parameters. Most traditional optimization methods tend to get trapped in local minima, and those that are robust with respect to this problem may have a steep associated computational cost. The result of these issues is that the quality of estimated parameters using these methods may be mediocre and sensitive to measurement noise.

To address the problems outlined above, the dimensionality of the parameter space must be reduced, and the parameters of the media model should ideally be decoupled from those of the thermal model. In addition, if possible, the cost surface should have a unique global minimum with respect to the parameters. All of these objectives are achieved using the parameter estimation methods of the present invention.

In the methods of the present invention, decoupling of the parameters is achieved by separating the steady state response of the system from the dynamic response. The print image quality is determined by (among other variables) color accuracy and sharpness. Color accuracy may be estimated from measurements made in the steady state, whereas the dynamic response contributes more to the perception of sharpness.

The steady state media model of Equations 10, 11 and 12 allows decoupling of the steady state and dynamic responses in this way. The steady state response of the thermal system is included in the effective sensitivities. These effective sensitivities (together with the gamma function) become the only parameters that need to be estimated.

The dimensionality of the parameter set is addressed in the following way in the methods of the present invention. Note that the parameters of the steady state media model are C+1 one-dimensional functions of density. For a well-behaved system, these functions will be smooth and continuous. As a result, compact model representations of the functions are possible.

A preferred model for use in the present invention is the well-known spline model described, for example, in M. Unser, "Splines—A Perfect Fit for Signal and Image Processing", IEEE Signal Proc. Magazine, vol. 16, no. 6, pp. 22-38 (1999). The spline model represents the unknown function using polynomial pieces. The continuity of the functions can be controlled by varying the degree of the polynomials and the multiplicity of the knots (i.e., points at which different polynomial pieces abut). The locations of the knots also allows us to vary the resolution of the function in different regions of density space.

The effective temperature and cross energy sensitivities are modeled in the methods of the present invention using B-splines as:

$$S_{ck}^{e}(d_c) = \sum_{m=1}^{M} s_{ck}(m) B_m^p(d_c),\ \forall\, k \in C \qquad \text{Equation 13}$$

where $B_m^p(d_c)$ is the $m^{th}$ B-spline of order p for the knot sequence $t_1 \leqq t_2 \leqq \ldots \leqq t_{M+p}$. Once the order of the spline and the number and location of the sequence have been chosen, the only unknowns are the spline coefficients $S_{ck}(m)$.

The inverse gamma function is represented in a similar fashion using B-splines as:

$$\Gamma^{-1}(d_c) = \sum_{m=1}^{M} g_c(m) B_m^p(d_c), \qquad \text{Equation 14}$$

where $g_c(m)$ are the unknown coefficients. The number of knots M and the order of the spline p may be chosen differently for each sensitivity and inverse gamma function.

The spline representation allows the unknown functions to be reduced to a compact set of (C+1) $\overline{M}$ parameters per color, where $\overline{M}$ is the mean number of knots. For example, in a three-color system with M chosen to be 5 for all colors, the total number of unknowns is equal to 20.

The cost surface can be made linear with respect to these parameters as follows. The equation that needs to be satisfied for every color is Equation 10 expressed in terms of the B-spline model:

$$E_c = \sum_{m=1}^{M} g_c(m) B_m^p(d_c) + \Delta T_s \sum_{m=1}^{M} s_{cc}(m) B_m^p(d_c) + \sum_{k \neq c} E_k \sum_{m=1}^{M} s_{ck}(m) B_m^p(d_c) \qquad \text{Equation 15}$$

Equation 15 can be written as the dot product of two vectors $$E_c = \vec{B}(d_c, \Delta T_s, \{E_k, k \neq c\}) \bullet \vec{x} \qquad \text{Equation 16}$$

where $\vec{B}$ is a row vector whose entries are functions of $d_c$, $\Delta T_s$ and $\{E_k, k \neq c\}$ and $\vec{x}$ is a column vector containing the unknown spline coefficients that need to be determined. The vector $\vec{x}$ can be estimated by collecting a large number of data points by printing using the actual printer under a variety of conditions. Each data set consists of a set of measurements $\{\hat{E}_c, \hat{d}_c, \Delta\hat{T}_s\}_i\ \forall c \in C$ made in the steady state. Here i denotes the number of the measurement set in the data and the symbol ^ denotes measurement values. These sets of measurements are required to fit Equation 16. One method of estimating the unknown $\vec{x}$ is to minimize the following error:

$$\vec{\hat{x}} = \underset{\vec{x}}{\operatorname{argmin}} \sum_i \left| \hat{E}_{ci} - \vec{B}\left(\hat{d}_{ci}, \Delta\hat{T}_{si}, \{\hat{E}_{ki}, k \neq c\}\right) \cdot \vec{x} \right|^q \qquad \text{Equation 17}$$

where the notation $$\text{"}\underset{\vec{x}}{\operatorname{argmin}}\text{"}$$

denotes the set of coefficients that minimizes the sum, and q controls how the errors are weighted. When q=2 the solution for Equation 17 can be written in closed form as:

$$\vec{\hat{x}} = (B^T B)^{-1} B^T \vec{\hat{E}}_c \qquad \text{Equation 18}$$

where the matrix is constructed using the row vectors $\vec{B}$ such that the $i^{th}$ row of the matrix is $\vec{B}(\hat{d}_{ci}, \Delta\hat{T}_{si}, \{\hat{E}_{ki}, k \neq c\})$ and the column vector $$\vec{\hat{E}}_c$$

has its $i^{th}$ element as $\hat{E}_{ci}$.

The choice of q=2 in Equation 17 yields a closed form expression for $\vec{x}$ and is the optimal value to use when the noise in the data is Gaussian. In practice, however, the choice of q=2 does not yield the most desirable results. It is well known that the least squares estimate is not robust to the presence of outliers. The quadratic error metric tends to attribute an unduly large importance to the large deviations from the norm and the estimates are disproportionately swayed by a few aberrant data points. As the value of q is reduced, less and less penalty is assigned to outlying data points. However, with q<1, the cost function of Equation 17 becomes non-convex and the local minima begin to emerge. The lack of a unique global minimum is undesirable. For this reason, it is preferred to use q=1 in the methods of the present invention. Although no closed form solution exists for the parameters in this case, the problem of Equation 17 is easily solved by a host of standard iterative optimization algorithms. Once an iterative optimization algorithm is used, constraints can also be imposed on the spline coefficients of the unknown functions. For instance, the inverse gamma function is required to be positive and monotonically increasing with density, while the temperature and energy sensitivities are required to be negative (because an increased temperature always results in a lowering of the energy required to reach a desired density). Constraints such as these cannot be enforced in the closed form solution that is obtained when q=2.

Figure 14:
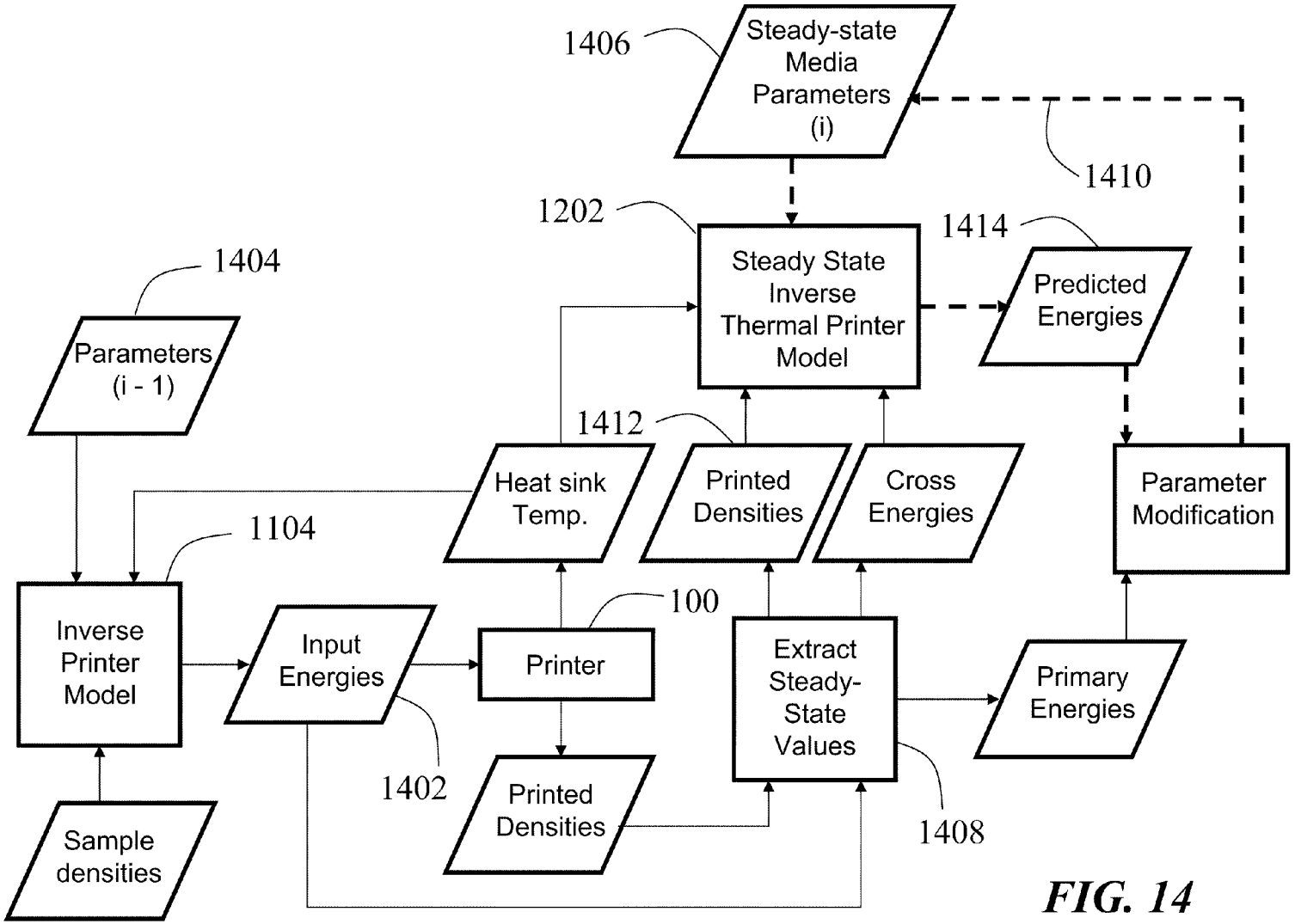

FIG. 14 shows a preferred method of the present invention for estimating the media model parameters in the steady state. A significant difference between this framework and the method of FIG. 13 is that here the error is minimized in the energy domain as opposed to the density domain.

An initial set of input energies 1402 is fed to the actual printer under consideration and its response is recorded both in terms of the heat sink temperature and the densities on print 1412. The density measurements are then culled to extract only the data in steady state where the media model of Equation 10 is valid (1408). The corresponding energies at steady state are then identified. The data is then used in Equation 17 to obtain the estimate of the steady-state media model parameters 1406 (the iteration is over loop 1410 (with iteration index i), shown with dashed arrows in FIG. 14).

A better estimate of the steady-state media parameters can be made by using the newly-generated steady state parameters, along with default thermal parameters, as input 1404 to the inverse printer model that may be used to generate a new set of input energies.

The temperature sensitivity of the inverse printer model can be computed from the effective temperature sensitivity estimate (obtained at steady state using the above techniques) from Equation 11 as:

$$S_c(d_c) = \frac{S_c^e(d_c)}{1 + \Theta_{cc} S_c^e(d_c)} \qquad \text{Equation 19}$$

The residual cross sensitivities can be computed from the effective sensitivities (obtained at steady state) as:

$$\Delta S_{ck}(d_c) = \frac{S_{ck}^e(d_c) - \Theta_{ck} S_c^e(d_c)}{1 + \Theta_{cc} S_c^e(d_c)} \qquad \text{Equation 20}$$

Having used the framework shown in FIG. 14 to estimate the steady state media model parameters, the framework of FIG. 13 can now be employed to estimate the remaining thermal parameters of the model. The problem is now much simpler because the number of parameters to estimate simultaneously has been reduced significantly. This improves the ability of an optimizer to find the global minimum and to produce parameter estimates with good performance. Note that since the remaining thermal parameters control only the dynamical response of the system, the data fed to the optimizer should be culled to identify only those portions of the data set that are not in steady state. Irrespective of the values that the optimizer determines for the thermal model parameters, the steady state response of the system will remain fixed.

As discussed previously, the thermal model parameters primarily end up controlling the perceived sharpness of the printed image and may even be modified from the predetermined values to obtain more visually pleasing results.

Figure 15:
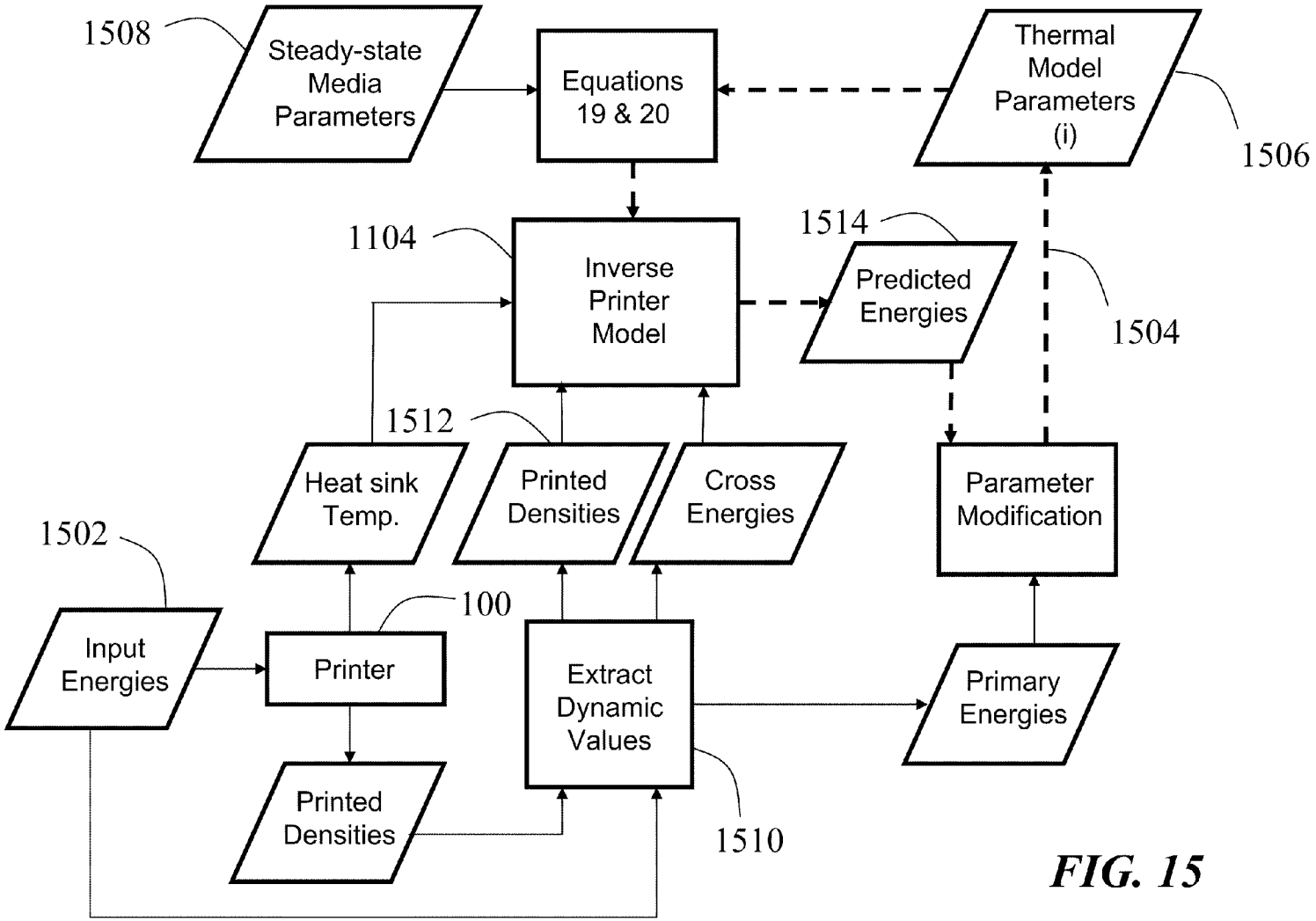

FIG. 15 shows an alternative framework of the present invention for estimating the thermal model parameters 1506 by minimizing the error in the energy domain. The advantage of this method is that the (inverse) media model within the inverse printer model of FIG. 11 can be computed in closed form whereas the (forward) media model of the forward printer of FIGS. 10 and 13 requires a more computationally intensive iterative method.

Referring now to FIG. 15, prints are made using the printer 100 under consideration and the dynamic portion of the data (measured densities 1512 and supplied energies) is extracted (1510). Note that the dynamic data should be contiguous in time with a known initial thermal state of the printer, as the model needs to track the state of the print head for the complete time extent of the data.

The differences between the actual energies and those predicted by the inverse printer model are minimized in order to optimize the thermal model parameters 1506. The iteration is shown by dashed arrows 1504 in FIG. 15. The steady-state media parameters 1508 estimated using the method illustrated in FIG. 14 are used to provide the temperature sensitivity and residual cross-energy parameters required by the inverse printer model (by means of equations 19 and 20).

Constraints on the thermal parameters are imposed to ensure that the full set of parameters yield a stable and non-oscillatory response. Stability of the algorithm is affected by both the sensitivities and the thermal parameters. It is possible to analyze the stability of the inverse printer feedback algorithm and derive the conditions that are required for a stable and non-oscillatory response. These conditions can be evaluated when altering the thermal parameters, and constraints can be imposed on them to keep the overall algorithm stable.

Figure 16:
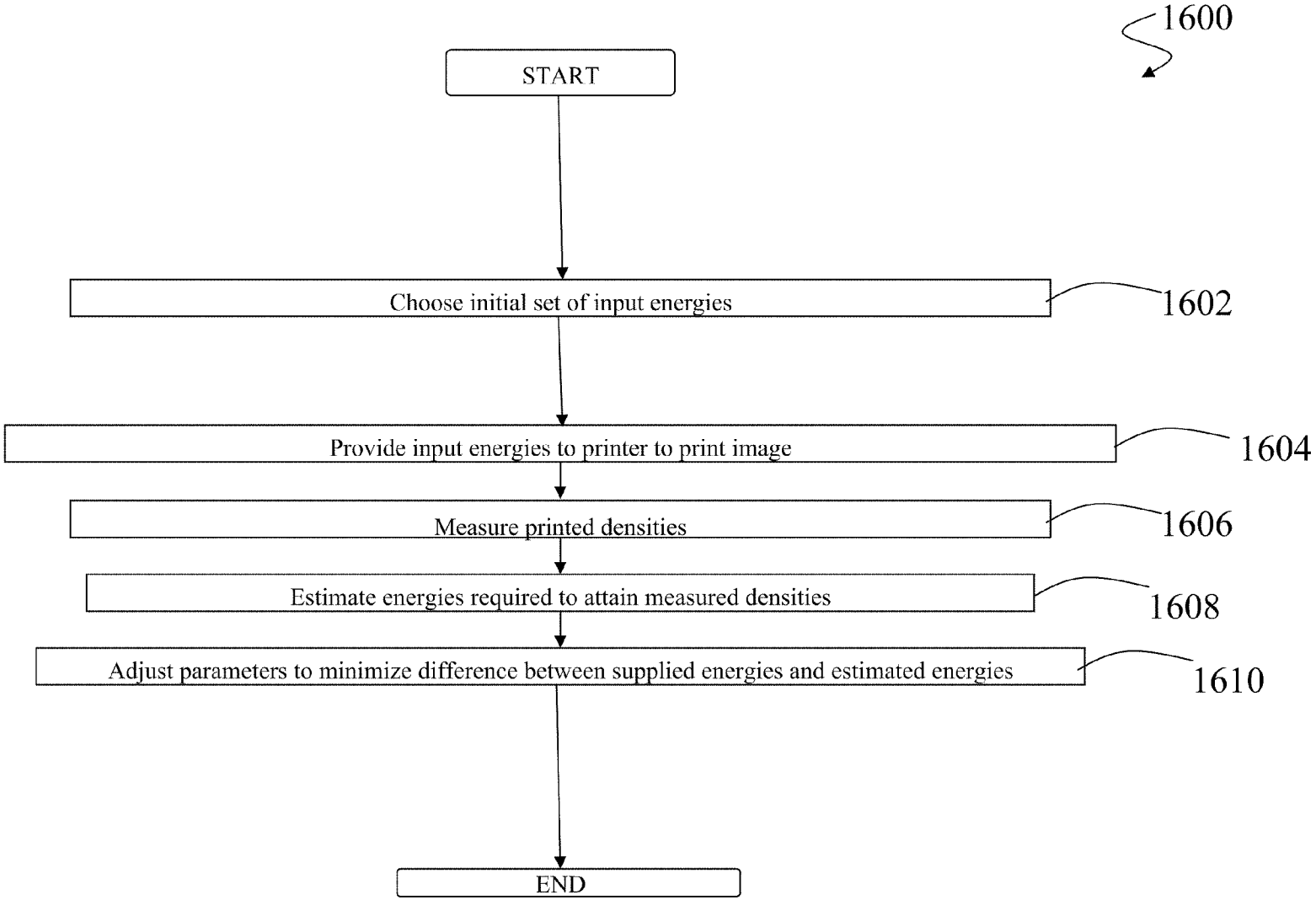
FIG. 16 is a flowchart of a method for performing parameter estimation by minimizing error in the energy domain.

Referring to FIG. 16, a flowchart is shown of a method 1600 for performing parameter estimation by minimizing the error in the energy domain according to one embodiment of the present invention. Although certain elements of the method 1600 of FIG. 16 will be described by reference to elements of FIGS. 14 and 15, this is done merely for purposes of example and does not constitute a limitation of the present invention.

An initial set of input energies is chosen (step 1602), such as in element 1402 of FIG. 14 or element 1502 of FIG. 15. The initial input energies are provided to the printer to print an image (step 1604), such as is shown by elements 1402 and 100 of FIG. 14 or elements 1502 and 100 of FIG. 15. The printed densities in the printed image are measured (step 1606), such as is shown by element 1412 of FIG. 14 or element 1512 of FIG. 15.

The energies required to attain the measured densities are estimated (step 1608), such as is shown by element 1414 of FIG. 14 or element 1514 of FIG. 15. The thermal model parameters are adjusted to minimize the difference between the supplied energies and the estimated energies (step 1610), such as is shown by element 1406 of FIG. 14 or element 1506 of FIG. 15. As indicated by the dashed lines in FIGS. 14 and 15, the parameter modification process may be iterative.

The techniques disclosed herein have a variety of advantages. For example, the techniques disclosed herein may be applied to perform thermal history control in a thermal printer in which a single thermal print head prints sequentially on multiple color-forming layers in a single pass. By applying different energy computation functions to different color-forming layers, the techniques disclosed herein enable the thermal history control to be optimized for each of the color-forming layers, thereby improving the quality of printed output. By applying different thermal model parameters to different color-forming layers, the techniques disclosed herein may be used to model the thermal response of the output medium during printing segments of unequal duration. By computing an energy to supply to a print element based on the desired print density of a particular color, and applying a correction to that energy based on the current temperature of the print element and the energies supplied to the print head element when printing other colors in the current or previous line, the rendering of an incorrect color due to residual heat in the imaging medium may be avoided.

As a result, the thermal history control algorithm may be used in conjunction with printers printing more than one superimposed color on a thermal imaging member, thereby improving the quality of printed output. Such use of varying energy computation functions and thermal model parameters may be used in combination, thereby optimizing the thermal history control algorithm for use with thermal printers in which a single thermal print head prints sequentially on multiple color-forming layers in a single pass using pixel-printing segments of unequal duration.

Furthermore, the techniques disclosed herein have the advantages disclosed in the above-referenced patent applications. For example, the techniques disclosed herein reduce or eliminate the problem of "density drift" and of printing distorted colors by taking the current ambient temperature of the print head and the thermal and energy histories of the print head into account when computing the energy to be provided to the print head elements, thereby raising the temperatures of the print head elements only to the temperatures necessary to produce the desired densities. A further advantage of various embodiments of the present invention is that they may either increase or decrease the input energy provided to the print head elements, as may be necessary or desirable to produce the desired densities.

In general, the techniques described above may be implemented, for example, in hardware, software, firmware, or any combination thereof. The techniques described above may be implemented in one or more computer programs executing on a programmable computer and/or printer including a processor, a storage medium readable by the processor (including, for example, volatile and non-volatile memory and/or storage elements), at least one input device, and at least one output device. Program code may be applied to data entered using the input device to perform the functions described herein and to generate output information. The output information may be applied to one or more output devices.

Printers suitable for use with various embodiments of the present invention typically include a print engine and a printer controller. The printer controller may, for example, receive print data from a host computer and generates page information to be printed based on the print data. The printer controller transmits the page information to the print engine to be printed. The print engine performs the physical printing of the image specified by the page information on the output medium.

Elements and components described herein may be further divided into additional components or joined together to form fewer components for performing the same functions.

Each computer program within the scope of the claims below may be implemented in any programming language, such as assembly language, machine language, a high-level procedural programming language, or an object-oriented programming language. The programming language may be a compiled or interpreted programming language.

Each computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output.

It is to be understood that although the invention has been described above in terms of particular embodiments, the foregoing embodiments are provided as illustrative only, and do not limit or define the scope of the invention.

I claim:

1. A method for thermal printing of a digital image on a thermal imaging member with a thermal print head comprising at least one print head element, comprising:

(A) identifying a density value of a color component of a pixel in the digital image, the pixel comprising N color components, each of the color components associated with one of N printing segments of a printing line time where N>1;

(B) identifying a print head element temperature;

(C) identifying at least one amount of energy supplied to the print head element during each of N−1 previous printing segments;

(D) identifying an energy computation function associated with the color component;

(E) identifying at least one function of the amount of energy identified in (C);

(F) identifying an input energy amount using the energy computation function and the density value, the print head element temperature, and the at least one function of the amount of energy;

(G) supplying energy equal to the input energy amount to the print head element;

wherein (A), (B), (C), (D), (E), and (F) are performed by a processor executing computer program instructions tangibly stored on a computer-readable medium.

2. The method of claim 1, wherein N=3, wherein (C) comprises:

(C) (1) identifying an amount of energy supplied to the print head during a first printing segment of the printing line time; and (C) (2) identifying an amount of energy supplied to the print head during a second printing segment of the printing line time; and wherein (F) comprises identifying the input energy by performing a 4-way lookup using the identified density value, the identified print head element temperature, the identified amount of supplied energy, the amount of energy supplied to the print head during the first printing segment of the printing line time, and the amount of energy supplied to the print head during the second printing segment of the printing line time.

3. The method of claim 2, wherein the energy computation function comprises a component function having as input the amounts of energy supplied to the print head element during each of the previous N−1 printing segments.

4. The method of claim 3, wherein (F) comprises steps of:

(F) (1) computing an uncorrected energy based on the density value;

(F) (2) making a first correction to said uncorrected energy based on said print head element temperature to produce a temperature-corrected energy, wherein the magnitude of said first correction depends upon the density value; and (F) (3) obtaining the input energy from said temperature-corrected energy by making a second correction based on the amounts of energy supplied to the print head element during each of the previous N−1 printing segments, wherein the magnitude of said second correction depends upon the density value.

5. The method of claim 4, wherein step (F) comprises steps of:

(F) (1) computing an uncorrected energy based on the density value;

(F) (2) making a first correction to said uncorrected energy by making a first correction based on the amounts of energy supplied to the print head element during each of the previous N−1 printing segments, wherein the magnitude of said second correction depends upon the density value; and (F)(2) obtaining the input energy from said energy-corrected energy by making a second correction based on said print head element temperature to produce a temperature-corrected energy, wherein the magnitude of said second correction depends upon the density value.

6. The method of claim 5, wherein the pixel comprises one of a plurality of pixels in the digital image, and wherein the method further comprises a step of performing steps (A)-(G) for each of the plurality of pixels.

7. The method of claim 6, wherein (B) comprises identifying the temperature of the print head element using a model based on the amount of energy supplied during the previous printing segment.

8. The method of claim 7, wherein the print head element temperature is derived from a measurement.

9. The method of claim 8, wherein the energy computation function in step (D) has the form:

$$E_c(n_c) = G_c(d_c) + S_c(d_c)T_{ac}(n_c) + \sum_{k \neq c} \Delta S_{ck}(d_c)E_k(n_{ck}),\ \forall\, c \in C.$$

10. An apparatus for printing of a digital image on a thermal imaging member with a thermal print head comprising at least one print head element, the apparatus comprising:

means for identifying a density value of a color component of a pixel in the digital image, the pixel comprising N color components, each of the color components associated with one of N printing segments of a printing line time where N>1;

means for identifying a print head element temperature;

means for identifying at least one amount of energy supplied to the print head element during each of N−1 previous printing segments;

means for identifying an energy computation function associated with the color component;

means for identifying at least one function of the amount of the identified energy;

means for identifying an input energy amount using the energy computation function and the density value, the print head element temperature, and the at least one function of the amount of energy; and means for supplying energy equal to the input energy amount to the print head element.

11. A method for thermal printing of a digital image on a thermal imaging member with a thermal print head comprising at least one print head element, comprising:

(A) identifying a density value of a color component of a pixel in the digital image, the pixel comprising N color components, each of the color components associated with one of N printing segments of a printing line time where N>1;

(B) identifying a print head element temperature;

(C) identifying at least one amount of energy supplied to the print head element during each of N−1 previous printing segments;

(D) identifying an energy computation function associated with the color component;

(E) identifying an input energy amount using the energy computation function and the density value, the print head element temperature, and the at least one amount of energy supplied to the print head element during each of the previous N−1 printing segments;

(F) supplying energy equal to the input energy amount to the print head element;

(G) storing a record of the input energy;

(H) repeating (A)-(G), wherein (C) comprises identifying the recorded input energy;

wherein (A), (B), (C), (D), (E), and (G) are performed by a processor executing computer program instructions tangibly stored on a computer-readable medium.

12. The method of claim 11, wherein (G) comprises storing a record of the input energy in a buffer having (N−1) elements.

13. The method of claim 11, wherein N=3, wherein (C) comprises:

(C) (1) identifying an amount of energy supplied to the print head during a first printing segment of the printing line time; and (C) (2) identifying an amount of energy supplied to the print head during a second printing segment of the printing line time; and wherein (E) comprises identifying the input energy by performing a 4-way lookup using the identified density value, the identified print head element temperature, the identified amount of supplied energy, the amount of energy supplied to the print head during the first printing segment of the printing line time, and the amount of energy supplied to the print head during the second printing segment of the printing line time.

14. The method of claim 11, wherein (E) comprises steps of:

(E) (1) computing an uncorrected energy based on the density value;

(E) (2) making a first correction to said uncorrected energy based on said print head element temperature to produce a temperature-corrected energy, wherein the magnitude of said first correction depends upon the density value; and (E) (3) obtaining the input energy from said temperature-corrected energy by making a second correction based on the amounts of energy supplied to the print head element during each of the previous N−1 printing segments, wherein the magnitude of said second correction depends upon the density value.

15. The method of claim 11, wherein step (E) comprises steps of:

(E) (1) computing an uncorrected energy based on the density value;

(E) (2) making a first correction to said uncorrected energy by making a first correction based on the amounts of energy supplied to the print head element during each of the previous N−1 printing segments, wherein the magnitude of said second correction depends upon the density value; and (E) (2) obtaining the input energy from said energy-corrected energy by making a second correction based on said print head element temperature to produce a temperature-corrected energy, wherein the magnitude of said second correction depends upon the density value.

16. The method of claim 11, wherein the pixel comprises one of a plurality of pixels in the digital image, and wherein the method further comprises a step of performing steps (A)-(H) for each of the plurality of pixels.

17. The method of claim 11, wherein (B) comprises identifying the temperature of the print head element using a model based on the amount of energy supplied during the previous printing segment.

18. The method of claim 11, wherein the print head element temperature is derived from a measurement.

19. The method of claim 11, wherein the energy computation function in step (D) has the form:

$$E_c(n_c) = G_c(d_c) + S_c(d_c)T_{ac}(n_c) + \sum_{k \neq c} \Delta S_{ck}(d_c)E_k(n_{ck}),\ \forall\ c \in C.$$

20. An apparatus for thermal printing of a digital image on a thermal imaging member with a thermal print head comprising at least one print head element, the apparatus comprising:

first means for identifying a density value of a color component of a pixel in the digital image, the pixel comprising N color components, each of the color components associated with one of N printing segments of a printing line time where N>1;

second means for identifying a print head element temperature;

third means for identifying at least one amount of energy supplied to the print head element during each of N−1 previous printing segments;

fourth means for identifying an energy computation function associated with the color component;

fifth means for identifying an input energy amount using the energy computation function and the density value, the print head element temperature, and the at least one amount of energy supplied to the print head element during each of the previous N−1 printing segments;

sixth means supplying energy equal to the input energy amount to the print head element;

seventh means for storing a record of the input energy;

means for applying the first means, second means, third means, fourth means, fifth means, sixth means, and seventh means a first time; and means for applying the first means, second means, third means, fourth means, fifth means, sixth means, and seventh means a second time, wherein the third means comprises means for identifying the recorded input energy.

21. A method for estimating a set of parameters for use in an energy computation function, the method comprising:

(A) choosing a set of non-zero input energies, associated with more than one segment of a line printing time of a printer, to supply to the printer;

(B) printing an image using the printer with the set of input energies;

(C) measuring the printed densities of regions of the image corresponding to each input energy in the set of input energies;

(D) estimating the energies required to attain each of the measured printed densities using a set of parameters; and (E) adjusting the set of parameters so as to minimize the differences between the estimates of the energy required to attain the measured printed densities and the input energies supplied to the printer to achieve the measured printed densities.

22. The method of claim 21, wherein at least part of the printing in step (B) is carried out in a steady state, and wherein (C) comprises measuring the printed densities of regions of the image printed in the steady state.

23. The method of claim 21, wherein the set of parameters that are adjusted in step (E) comprise values that are used to model the functions $G_c(d_c)$, $S_c(d_c)$ and $\Delta S_{ck}(d_c)$.

24. The method of claim 21, wherein at least part of the printing in step (B) is carried out in a dynamic state, and wherein (C) comprises measuring the printed densities of regions of the image printed in the dynamic state.

25. The method of claim 21, wherein each region of the image in step (C) is a region whose density does not vary by more than 10%.

26. The method of claim 21, wherein the set of parameters that are adjusted in step (E) minimize the error:

$$\sum_i \left|\hat{E}_{ci} - \vec{B}\left(\hat{d}_{ci}, \Delta\hat{T}_{si}, \{\hat{E}_{ki}, k \neq c\}\right)\cdot\vec{x}\right|^q.$$

27. The method of claim 26, wherein q=1.

28. An apparatus for estimating a set of parameters for use in an energy computation function, the apparatus comprising:

means for choosing a set of non-zero input energies, associated with more than one segment of a line printing time of a printer, to supply to the printer;

means for printing an image using the printer with the set of input energies;

means for measuring the printed densities of regions of the image corresponding to each input energy in the set of input energies;

means for estimating the energies required to attain each of the measured printed densities using a set of parameters; and means for adjusting the set of parameters so as to minimize the differences between the estimates of the energy required to attain the measured printed densities and the input energies supplied to the printer to achieve the measured printed densities.

* * * * *